US009332851B2

(12) United States Patent
Machael et al.

(10) Patent No.: US 9,332,851 B2
(45) Date of Patent: May 10, 2016

(54) CHAIR WITH ACTIVATED BACK FLEX

(71) Applicant: HNI Technologies Inc., Muscatine, IA (US)

(72) Inventors: Jay R. Machael, Muscatine, IA (US); Travis J. Crowell, Davenport, IA (US); Bruce Fifield, Milan (IT)

(73) Assignee: HNI Technologies Inc., Muscatine, IA (US)

( * ) Notice: Subject to any disclaimer, the term of this patent is extended or adjusted under 35 U.S.C. 154(b) by 176 days.

(21) Appl. No.: 14/212,772

(22) Filed: Mar. 14, 2014

(65) Prior Publication Data

US 2014/0265493 A1 Sep. 18, 2014

Related U.S. Application Data

(60) Provisional application No. 61/793,272, filed on Mar. 15, 2013.

(51) Int. Cl.

| | |
|---|---|
| ***A47C 7/46*** | (2006.01) |
| ***A47C 7/44*** | (2006.01) |
| ***A47C 5/12*** | (2006.01) |

(52) U.S. Cl.

CPC ... *A47C 7/44* (2013.01); *A47C 5/12* (2013.01); *A47C 7/445* (2013.01); *A47C 7/46* (2013.01); *Y10T 29/49826* (2015.01)

(58) Field of Classification Search

CPC ..... A47C 7/44; A47C 5/12; A47C 7/445; A47C 7/46; Y10T 29/49826

USPC ..... 297/285, 301.1, 284.7, 452.34, 452.18; 29/428

See application file for complete search history.

(56) References Cited

U.S. PATENT DOCUMENTS

| | | | | |
|---|---|---|---|---|
| 186,462 | A | 1/1877 | Clay | |
| 909,751 | A | 1/1909 | Butcher et al. | |
| 1,290,532 | A | 1/1919 | Fischer | |
| 1,376,382 | A * | 4/1921 | Horine ..... | B60N 2/7058 297/285 |
| 2,312,030 | A | 2/1943 | Cramer et al. | |
| 2,471,024 | A | 5/1949 | Cramer | |
| 2,796,920 | A | 6/1957 | Cowles | |
| 3,102,753 | A | 9/1963 | Schliephacke | |

(Continued)

FOREIGN PATENT DOCUMENTS

| | | | |
|---|---|---|---|
| BD | 1302 | S | 2/2015 |
| CN | ZL2014303935083 | S | 6/2015 |

(Continued)

OTHER PUBLICATIONS

"Contessa Task" by Teknion, copyright 2003-2004, downloaded from http://www.teknion.com/products/seating, 2 pages.

(Continued)

*Primary Examiner* — Milton Nelson, Jr.
(74) *Attorney, Agent, or Firm* — Faegre Baker Daniels LLP

(57) ABSTRACT

A chair back that includes a back support, an upright frame, and at least one flex wing. The back support is substantially flexible and has a first side portion and a second side portion. The upright frame is substantially rigid and has a first frame side and a second frame side. The flex wing is located between the first frame side and the first side portion, where the flex wing includes a front portion coupled to the first side portion, a back portion coupled to the first frame side, and a web portion interconnecting the front portion and the back portion. The flex wing flexes during engagement by a user.

35 Claims, 21 Drawing Sheets

(56) References Cited

U.S. PATENT DOCUMENTS 3,258,259 A 6/1966 Bohlin
3,453,024 A 7/1969 Williams
3,565,482 A * 2/1971 Blodee ..... A47C 7/14 297/284.3
4,014,507 A 3/1977 Swenson
4,155,592 A 5/1979 Tsuda et al.
4,168,050 A 9/1979 Nerem et al.
4,429,917 A 2/1984 Diffrient
4,502,729 A 3/1985 Locher
4,623,193 A 11/1986 Lieker
4,653,806 A 3/1987 Willi
4,761,033 A 8/1988 Lanuzzi et al.
4,773,706 A 9/1988 Hinrichs
4,865,384 A 9/1989 Desanta
4,909,472 A 3/1990 Piretti
4,962,962 A 10/1990 Machate et al.
4,988,145 A 1/1991 Engel
5,029,942 A * 7/1991 Rink ..... B60N 2/4876 297/188.07
5,110,182 A 5/1992 Beauvais
5,150,948 A 9/1992 Volkle
5,308,144 A 5/1994 Korn
5,366,274 A 11/1994 Roericht et al.
5,486,035 A 1/1996 Koepke et al.
5,507,559 A 4/1996 Lance
5,599,069 A 2/1997 Lorbiecki
5,601,337 A 2/1997 Choda et al.
5,649,740 A 7/1997 Hodgdon
5,660,439 A 8/1997 Unwalla
5,716,098 A 2/1998 Lance
5,755,488 A 5/1998 Beda et al.
5,772,282 A 6/1998 Stumpf et al.
5,775,774 A 7/1998 Okano
5,797,652 A 8/1998 Darbyshire
5,810,440 A 9/1998 Unwalla
5,826,940 A 10/1998 Hodgdon
5,934,758 A 8/1999 Ritch et al.
RE36,335 E 10/1999 Perry
5,979,984 A 11/1999 DeKraker et al.
6,035,901 A 3/2000 Stumpf et al.
6,176,548 B1 1/2001 Thole et al.
6,254,186 B1 7/2001 Falzon
6,286,900 B1 9/2001 Roark
6,296,309 B1 10/2001 Kurtz
6,318,800 B1 11/2001 DeKraker
6,367,876 B2 4/2002 Caruso et al.
6,367,877 B1 4/2002 Knoblock et al.
6,394,545 B2 5/2002 Knoblock et al.
6,394,546 B1 5/2002 Knoblock et al.
6,394,548 B1 5/2002 Battey et al.
6,394,549 B1 5/2002 DeKraker et al.
6,474,737 B1 11/2002 Canteleux et al.
6,511,128 B2 1/2003 Piretti
6,513,874 B1 2/2003 Sander et al.
6,523,898 B1 2/2003 Ball et al.
6,565,153 B2 5/2003 Hensel et al.
6,568,760 B2 5/2003 Davis et al.
6,572,190 B2 6/2003 Koepke et al.
D476,821 S 7/2003 Koepke et al.
6,588,842 B2 7/2003 Stumpf et al.
6,609,755 B2 8/2003 Koepke et al.
6,616,231 B2 9/2003 Koepke et al.
6,626,497 B2 9/2003 Nagamitsu et al.
6,644,741 B2 11/2003 Nelson et al.
6,669,292 B2 12/2003 Koepke et al.
6,688,692 B2 2/2004 Phillips et al.
6,709,057 B2 3/2004 Sander et al.
6,709,058 B1 3/2004 Diffrient
6,709,060 B1 3/2004 Su
6,722,741 B2 4/2004 Stumpf et al.
6,729,691 B2 5/2004 Koepke et al.
6,739,664 B2 5/2004 Kinoshita et al.
6,749,261 B2 6/2004 Knoblock et al.
6,761,406 B2 7/2004 Kinoshita et al.
D493,627 S 8/2004 Ma
6,802,566 B2 10/2004 Prince et al.
6,817,667 B2 11/2004 Pennington et al.
6,840,582 B2 1/2005 Burwell et al.
6,843,530 B1 1/2005 Wu
6,863,346 B2 3/2005 Zund
6,874,852 B2 4/2005 Footitt
6,896,329 B2 5/2005 Sander et al.
6,905,171 B2 6/2005 Dammermann et al.
6,908,159 B2 6/2005 Prince et al.
6,913,316 B2 7/2005 Kinoshita et al.
6,935,689 B2 8/2005 Horiki et al.
6,945,602 B2 9/2005 Fookes et al.
6,957,861 B1 10/2005 Chou et al.
6,959,965 B2 11/2005 Diffrient
6,966,604 B2 11/2005 Stumpf et al.
6,981,743 B2 1/2006 Edwards et al.
6,986,549 B2 * 1/2006 Kniese ..... A47C 7/405 297/284.1
6,991,291 B2 1/2006 Dammermann et al.
6,994,400 B2 2/2006 Koepke et al.
7,014,269 B2 3/2006 Coffield et al.
7,040,709 B2 5/2006 Dammermann et al.
7,063,384 B2 * 6/2006 Liu ..... A47C 7/40 297/284.4
7,066,537 B2 6/2006 Coffield et al.
7,066,538 B2 6/2006 Machael et al.
7,104,604 B1 9/2006 Kang
7,114,777 B2 10/2006 Knoblock et al.
7,131,700 B2 11/2006 Dammermann et al.
7,134,722 B2 11/2006 Ueda et al.
D541,063 S 4/2007 Su
7,213,880 B2 5/2007 Schmitz et al.
7,213,886 B2 5/2007 Schmitz et al.
7,234,772 B2 6/2007 Wells
7,249,802 B2 7/2007 Schmitz et al.
7,273,253 B2 9/2007 Deimen et al.
7,281,764 B2 10/2007 Thole
D558,995 S 1/2008 Igarashi
D559,571 S 1/2008 Meda
D559,572 S 1/2008 Igarashi
7,347,495 B2 3/2008 Beyer et al.
7,360,835 B2 4/2008 Tubergen et al.
D572,948 S 7/2008 Wakasugi et al.
7,419,222 B2 9/2008 Schmitz et al.
7,422,287 B2 9/2008 Heidmann et al.
7,425,037 B2 9/2008 Schmitz et al.
7,441,839 B2 10/2008 Pennington et al.
D582,170 S 12/2008 Chi
7,484,802 B2 2/2009 Beyer et al.
7,517,024 B2 4/2009 Cvek
D600,462 S 9/2009 Ooki et al.
7,600,814 B2 10/2009 Link
7,665,805 B2 2/2010 Ueda
7,712,833 B2 5/2010 Ueda
7,717,513 B2 5/2010 Ueda
D618,469 S 6/2010 Romero
7,726,740 B2 6/2010 Masunaga
7,798,573 B2 9/2010 Pennington et al.
7,837,265 B2 11/2010 Machael et al.
7,841,666 B2 11/2010 Schmitz et al.
7,878,591 B2 2/2011 Walker et al.
D639,576 S 6/2011 Breen
7,971,936 B2 7/2011 Fukai
D643,641 S 8/2011 Figueroa
D643,642 S 8/2011 Figueroa
7,992,937 B2 8/2011 Plikat et al.
7,997,652 B2 8/2011 Roslund et al.
D646,092 S 10/2011 Romero
8,029,060 B2 10/2011 Parker et al.
8,061,775 B2 11/2011 Diffrient
D649,795 S 12/2011 Izawa
8,075,058 B2 12/2011 Baumann
D652,223 S 1/2012 Fujita
8,210,611 B2 7/2012 Aldrich et al.
8,215,710 B2 7/2012 Erker
8,251,448 B2 8/2012 Machael et al.
8,262,162 B2 9/2012 Castro et al.
8,297,701 B2 10/2012 Machael et al.
D671,759 S 12/2012 Hurford

(56) References Cited

U.S. PATENT DOCUMENTS

| | | | | |
|---|---|---|---|---|
| D676,254 | S | 2/2013 | Chen | |
| 8,414,073 | B2 | 4/2013 | Schmitz et al. | |
| D688,483 | S | 8/2013 | Aratani | |
| 8,550,557 | B2 | 10/2013 | Bock | |
| D696,886 | S | 1/2014 | Nakamura | |
| D701,068 | S | 3/2014 | Usumoto et al. | |
| D704,944 | S | 5/2014 | Koepke et al. | |
| D707,460 | S | 6/2014 | Giugiaro | |
| D714,070 | S | 9/2014 | Cvek | |
| D715,068 | S | 10/2014 | Chan | |
| D718,544 | S | 12/2014 | Lu | |
| D731,833 | S | 6/2015 | Fifield et al. | |
| 2002/0043843 | A1 | 4/2002 | Pennington et al. | |
| 2002/0190552 | A1 | 12/2002 | Koepke et al. | |
| 2002/0190553 | A1 | 12/2002 | Koepke et al. | |
| 2002/0190564 | A1 | 12/2002 | Coffield et al. | |
| 2003/0001425 | A1 | 1/2003 | Koepke et al. | |
| 2003/0075961 | A1 | 4/2003 | Struppler et al. | |
| 2003/0107252 | A1 | 6/2003 | Kinoshita et al. | |
| 2003/0127896 | A1 | 7/2003 | Deimen et al. | |
| 2003/0137173 | A1 | 7/2003 | Kinoshita et al. | |
| 2004/0017102 | A1 | 1/2004 | Igarashi et al. | |
| 2005/0062323 | A1 | 3/2005 | Dicks | |
| 2005/0093354 | A1 | 5/2005 | Ball et al. | |
| 2005/0121954 | A1 | 6/2005 | Coffield et al. | |
| 2005/0231013 | A1 | 10/2005 | Knoblock et al. | |
| 2005/0269848 | A1 | 12/2005 | Harley | |
| 2006/0001303 | A1 | 1/2006 | Raftery et al. | |
| 2006/0006715 | A1 | 1/2006 | Chadwick et al. | |
| 2006/0033369 | A1 | 2/2006 | Eysing | |
| 2006/0103208 | A1 | 5/2006 | Schmitz et al. | |
| 2006/0181126 | A1* | 8/2006 | Eysing | A47C 7/405 297/284.1 |
| 2007/0057549 | A1 | 3/2007 | Ball et al. | |
| 2007/0108818 | A1 | 5/2007 | Ueda et al. | |
| 2007/0108819 | A1 | 5/2007 | Ueda | |
| 2007/0108820 | A1 | 5/2007 | Ueda et al. | |
| 2007/0108821 | A1 | 5/2007 | Ueda | |
| 2007/0216208 | A1* | 9/2007 | Maier | A47C 7/46 297/284.4 |
| 2008/0272636 | A1 | 11/2008 | Machael et al. | |
| 2010/0295351 | A1 | 11/2010 | Bock | |
| 2011/0074197 | A1 | 3/2011 | Okamoto | |
| 2011/0193384 | A1 | 8/2011 | Ni | |
| 2011/0198909 | A1 | 8/2011 | Fifield | |
| 2011/0233979 | A1 | 9/2011 | An | |
| 2011/0285190 | A1 | 11/2011 | Wu | |
| 2011/0285191 | A1 | 11/2011 | van Hekken | |
| 2012/0007400 | A1 | 1/2012 | Behar et al. | |
| 2012/0025574 | A1 | 2/2012 | Wilkinson et al. | |
| 2013/0169014 | A1 | 7/2013 | Machael et al. | |

FOREIGN PATENT DOCUMENTS

| | | | |
|---|---|---|---|
| DE | 3640336 | A1 | 8/1987 |
| DE | 29507658 | U1 | 2/1996 |
| DE | 4437394 | A1 | 4/1996 |
| DE | 29711329 | U1 | 10/1997 |
| DE | 10318759 | B3 | 7/2004 |
| DE | 202008016260 | U1 | 4/2009 |
| EP | 0574375 | A1 | 12/1993 |
| EP | 0688522 | A1 | 12/1995 |
| EP | 0970639 | A1 | 1/2000 |
| EP | 1232703 | B1 | 8/2002 |
| EP | 1768516 | B1 | 4/2007 |
| EP | 2110051 | A1 | 10/2009 |
| JP | 2004049658 | A | 2/2004 |
| JP | 2004049691 | A | 2/2004 |
| KR | 20030059582 | A | 7/2003 |
| OM | ID201400020 | S | 6/2015 |
| WO | WO9220262 | A1 | 11/1992 |
| WO | WO02102197 | A2 | 12/2002 |
| WO | WO03068025 | A2 | 8/2003 |
| WO | WO2004008915 | A1 | 1/2004 |
| WO | 2007112236 | A1 | 10/2007 |
| WO | WO2013020088 | A2 | 2/2013 |

OTHER PUBLICATIONS

"Contessa: Ergonomic Concept", Okamura Today, copyright 2000-2004 Okamura Corporation, downloaded from http://www.okamura.co.jp/english/product/office/contessa/concept/index.html, 2 pages.

International Search Report and Written Opinion for PCT/US2008/056890 of HNI Technologies Inc., mailed Jul. 17, 2008.

International Search Report and Written Opinion issued in PCT/US2007/064413, mailed Aug. 16, 2007, 11 pages.

International Search Report and Written Opinion issued in PCT/US2014/028431, mailed Jul. 7, 2014, 9 pages.

International Preliminary Report on Patentability issued in PCT/US2014/028431, mailed Sep. 24, 2015, 6 pages.

* cited by examiner

CHAIR WITH ACTIVATED BACK FLEX

CROSS-REFERENCE TO RELATED APPLICATION

This application claims priority to Provisional Application No. 61/793,272, filed Mar. 15, 2013, which is hereby incorporated by reference in its entirety.

BACKGROUND

Chair manufacturers continually strive to improve the comfort, benefits, aesthetics, and manufacturability of the chairs they produce. Often, chairs have features, such as a reclining back, to increase comfort. Sometimes, chairs have features, such as adjustable seats, backs, back supports, armrests, and heights, to reduce or prevent injuries, including repetitive stress injury and back pain associated with sitting for long periods. Chairs are designed and built to fill an individual's needs and provide support where the individual needs it. In some chairs, the seat and back are fixed or the seat is fixed and the back tilts for comfort. In other chairs, the seat and back move together to support the user.

SUMMARY

Some embodiments described in this disclosure relate to a chair back that includes a back support, an upright frame, and at least one flex wing. The back support is substantially flexible and has a first side portion and a second side portion. The upright frame is substantially rigid and has a first frame side and a second frame side. The flex wing is located between the first frame side and the first side portion, where the first flex wing includes a front portion coupled to the first side portion, a back portion coupled to the first frame side, and a web portion interconnecting the front portion and the back portion. The flex wing flexes during user engagement.

Some embodiments relate to a chair including a base, a seat, and a back. The base supports the chair on a surface such that the seat and the back are supported by the base. The back includes a first upright, a second upright, a first wing, a second wing, and a back support. The first wing is attached to the first upright and includes a first web portion. The second wing is attached to the second upright and includes a second web portion. The back support is attached to the first upright and the second upright via the first wing and the second wing such that the first web portion extends between the back support and the first upright and the second web portion extends between the back support and the second upright.

Some embodiments relate to a method of making a chair back. The method includes: forming a back support that is substantially flexible and has a first side portion and a second side portion; forming at least one flex wing that has a front portion positioned at the first side portion of the back support, a back portion, and a web portion interconnecting the front portion and the back portion; and securing the back portion to a first frame side of an upright frame that is substantially rigid, such that the first flex wing flexes in response to force applied to the back support by the user.

While multiple embodiments are disclosed, still other embodiments within the inventive scope of the disclosure will become apparent to those skilled in the art from the following drawings and detailed description, which shows and describes illustrative embodiments. Accordingly, the drawings and detailed description are to be regarded as illustrative in nature and not restrictive.

DETAILED DESCRIPTION

Figure 1:
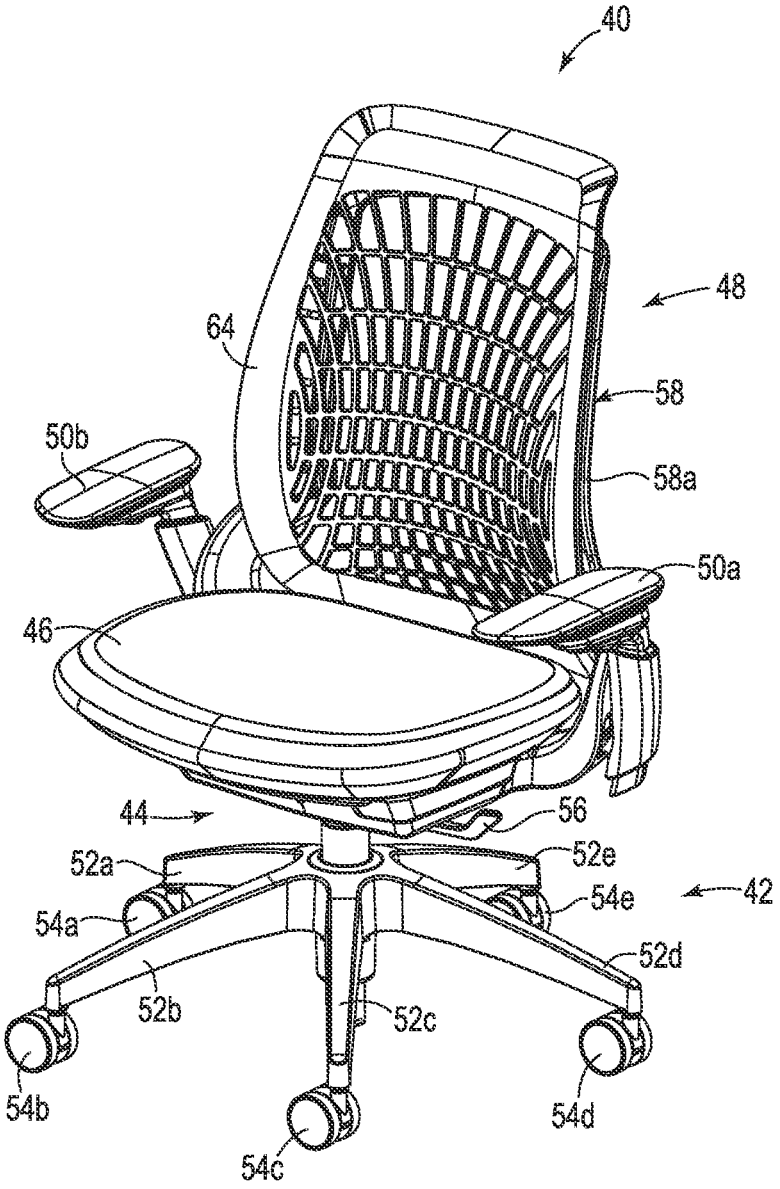
FIG. 1 is a diagram illustrating a perspective view of a chair, according to some embodiments.
Figure 2:
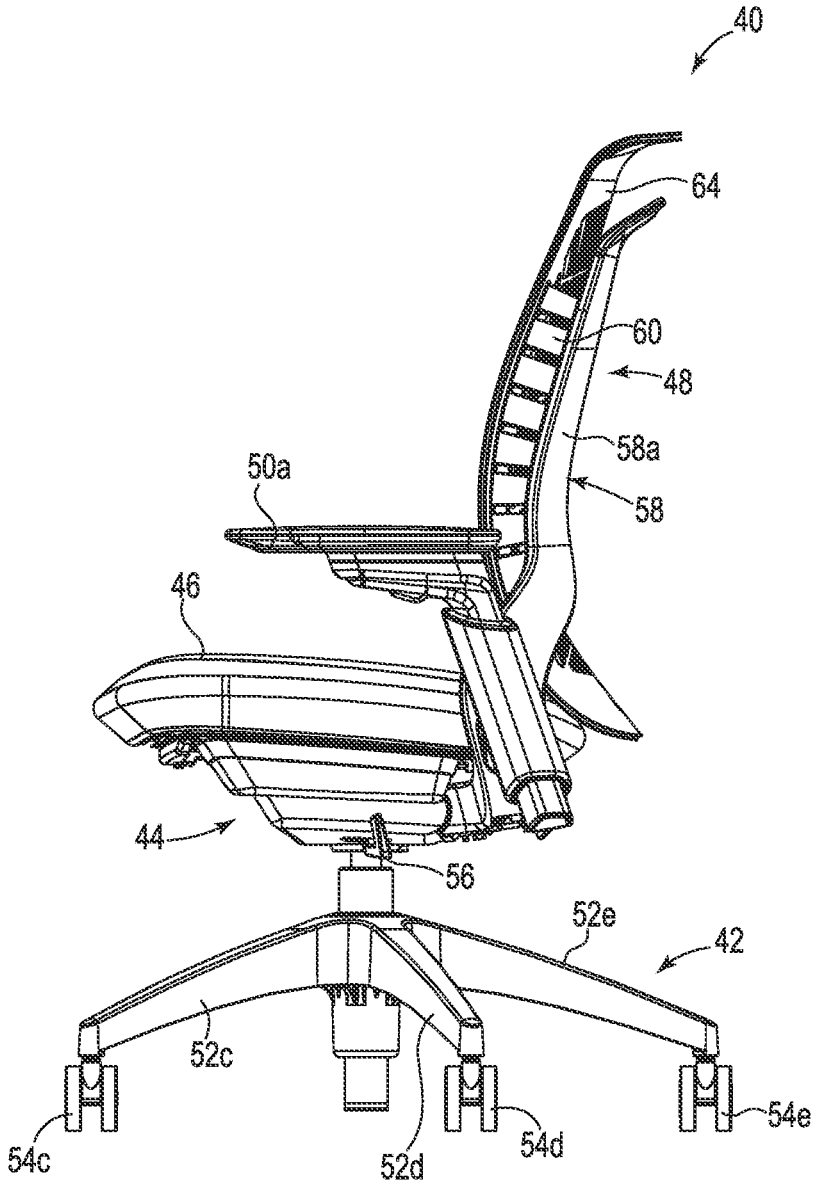
FIG. 2 is a diagram illustrating a side view of the chair of FIG. 1, according to some embodiments.
Figure 3:
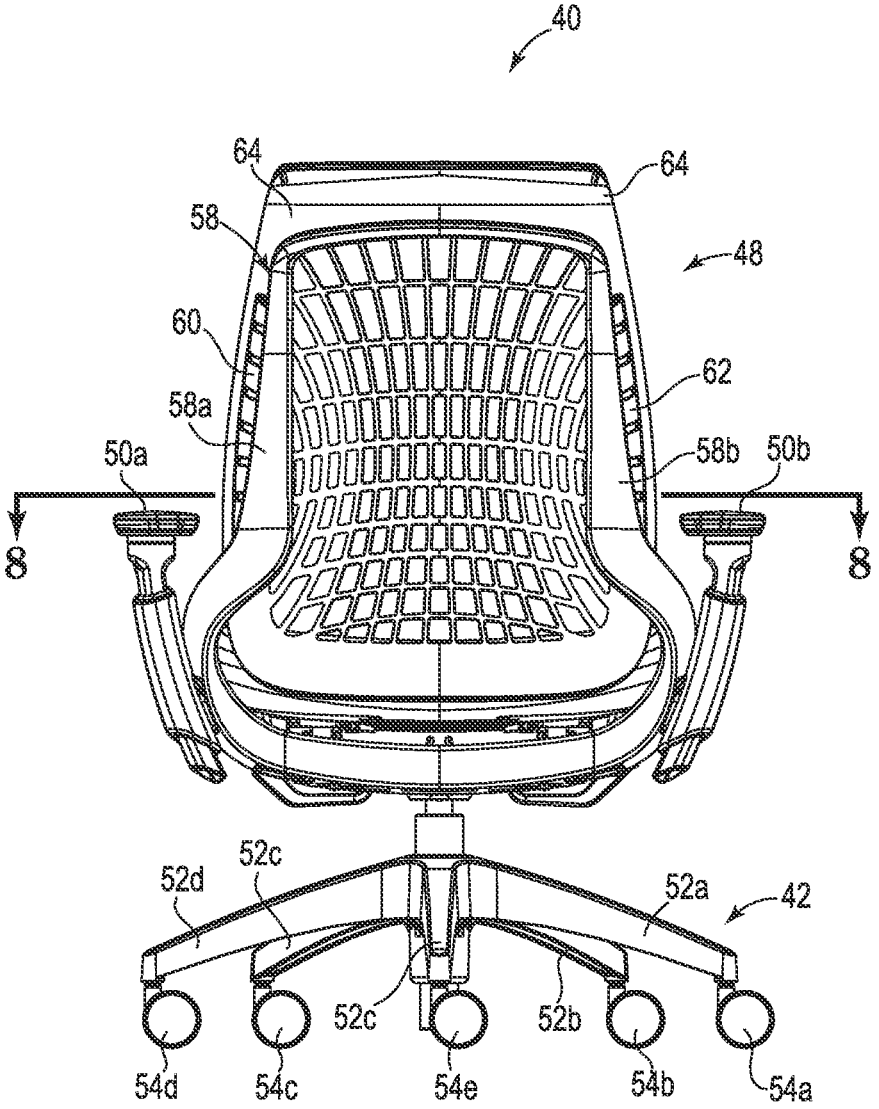
FIG. 3 is a diagram illustrating a back view of the chair of FIG. 1, according to some embodiments.

FIGS. 1-3 are diagrams illustrating a chair 40, according to some embodiments described in the disclosure. FIG. 1 is a diagram illustrating a perspective view of the chair 40, according to some embodiments. FIG. 2 is a diagram illustrating a side view of the chair 40, according to some embodiments. FIG. 3 is a diagram illustrating a back view of the chair 40, according to some embodiments. The other side of the chair 40 is, optionally, a mirror image of the side shown in FIG. 2, but otherwise substantially similar, such that the other side can be described with reference to the side shown in FIG. 2.

The chair 40 includes a base 42, a hub 44, a seat 46, a back 48, and armrests 50*a* and 50*b*. The base 42 supports the chair 40, including the hub 44, the seat 46, and the back 48, on a surface, such as the floor of an office building. The hub 44 is connected to the base 42, and the seat 46 and the back 48 are connected to and supported by the hub 44. In some embodiments, the armrests 50*a* and 50*b* are attached to the back 48. In some embodiments, the armrests 50*a* and 50*b* are attached to the hub 44. In some embodiments, the chair 40 does not include the armrests 50*a* and 50*b*.

The base 42 includes leg supports 52*a*-52*e* that support the chair 40 on the surface. Each of the leg supports 52*a*-52*e* includes a corresponding wheel 54*a*-54*e* for rolling the chair 40 on the surface. In some embodiments, the base 42 includes fewer than five leg supports 52*a*-52*e*. In some embodiments, the base 42 includes more than five leg supports 52*a*-52*e*. In some embodiments, each of the leg supports 52*a*-52*e* includes a corresponding foot, such that the chair 40 does not roll.

In some embodiments, the hub 44 is rotatably connected to the base 42, such that the seat 46 and the back 48 swivel on the base 42 via the rotating hub 44. In some embodiments, the hub 44 includes a lever arm 56 for adjusting the seat height or other adjustable aspects of the chair 40. In some embodiments, the hub 44 includes a weight activated control mechanism for raising and lowering the seat 46 in response to the user leaning or applying weight, or force, to the back 48.

The seat 46 supports the body of the user and the armrests 50*a* and 50*b* support the arms of the user. In some embodiments, each of the armrests 50*a* and 50*b* swivels to move with an arm of the user. In some embodiments, the height of each of the armrests 50*a* and 50*b* is adjustable to accommodate users of different sizes.

The back 48 supports the back of the user and flexes or bends to accommodate movements of the user. The back 48 includes an upright frame 58, first and second flexible (flex) wings 60 and 62, and a back support 64.

The upright frame 58 is supported by the base 42. In some embodiments, the upright frame 58 is secured to the base 42. In some embodiments, the upright frame 58 is secured to the hub 44.

The upright frame 58 includes a first frame side 58*a* and a second frame side 58*b*. In some embodiments, the upright frame 58 is U-shaped, with one arm of the U-shaped frame at the first frame side 58*a* and the other, opposite arm at the second frame side 58*b*. In some embodiments, the upright frame 58 is Y-shaped, with one arm of the Y-shaped frame at the first frame side 58*a* and the other, opposite arm at the second frame side 58*b*. In some embodiments, the upright frame 58 is H-shaped, with one arm of the H-shaped frame at the first frame side 58*a* and the other, opposite arm at the second frame side 58*b* and an interconnecting member (not shown) extending between the first and second frame sides 58*a*, 58*b*. In some embodiments, the upright frame 58 is a closed loop frame, such as a rectangular, circular, or oval shaped frame. In some embodiments, the upright frame 58 is a shell, such as a solid shell or a rigid shell, which extends from the first frame side 58*a* to the second frame side 58*b*.

As shown, the back support 64 is attached to the upright frame 58 at the first frame side 58*a* and the second frame side 58*b* via the first and second flex wings 60 and 62. The first flex wing 60 is situated between the first frame side 58*a* and the back support 64 and the second flex wing 62 is situated between the second frame side 58*b* and the back support 64.

Figure 4:
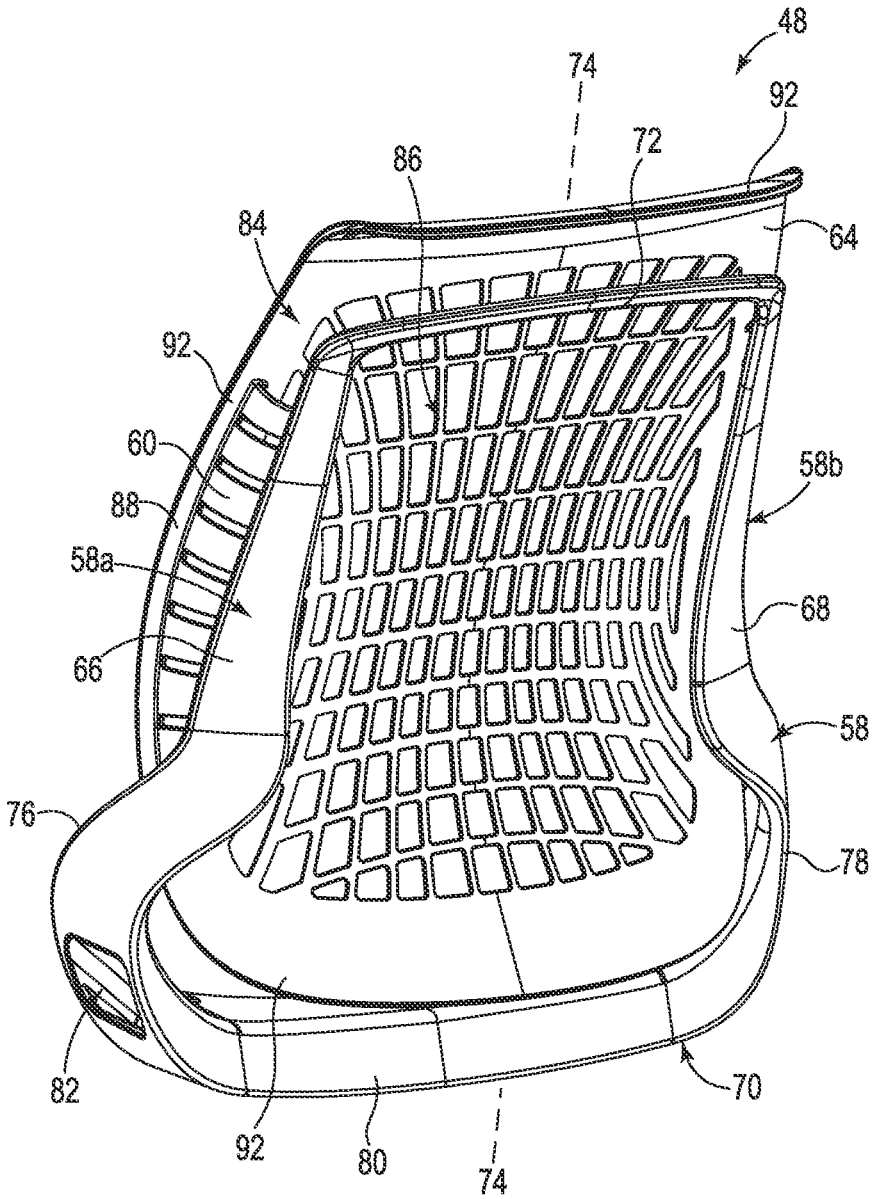
FIG. 4 is a diagram illustrating a rear perspective view of a back, according to some embodiments.
Figure 5:
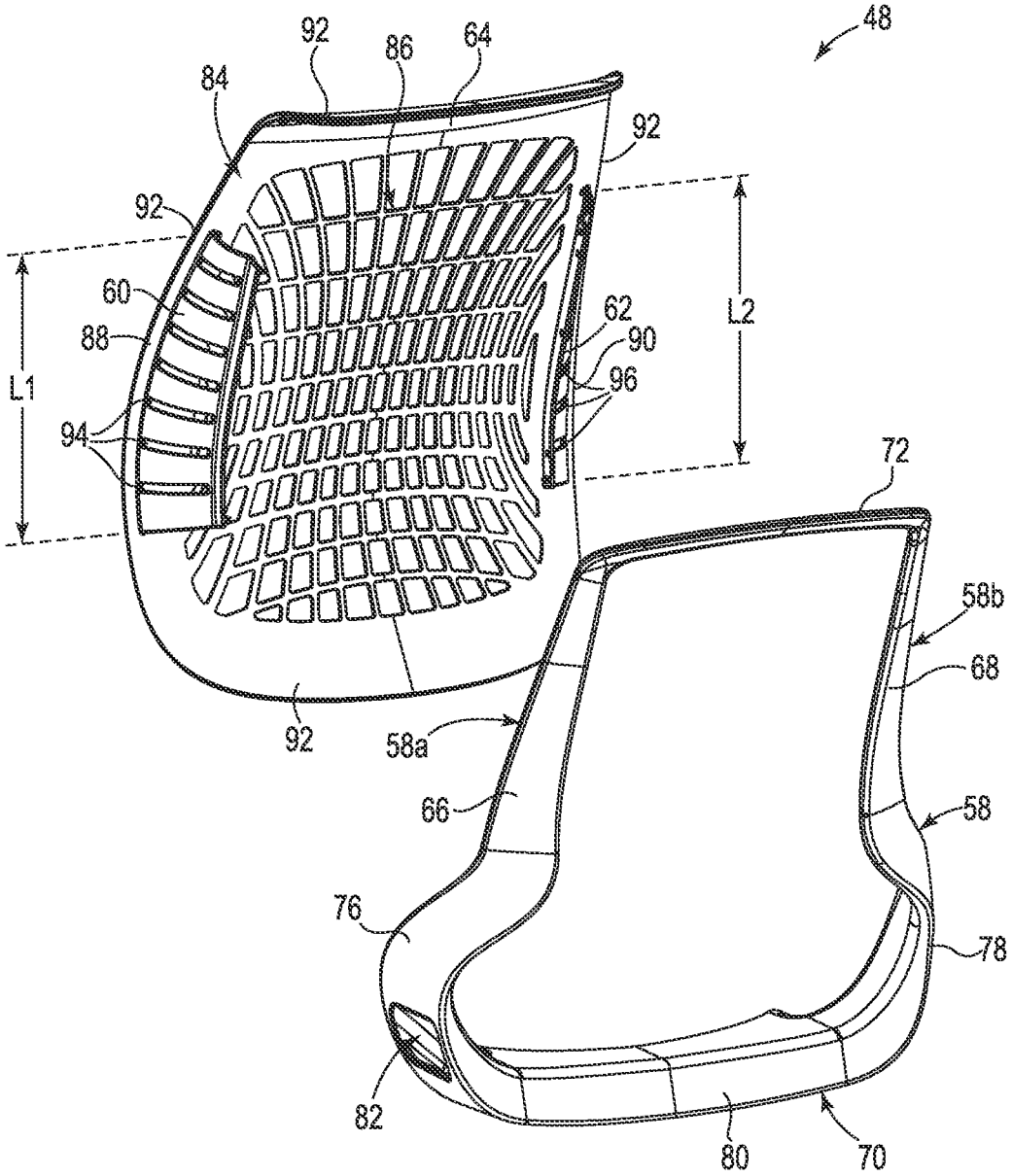
FIG. 5 is a diagram illustrating a rear exploded view of the back of FIG. 4, according to some embodiments.
Figure 6:
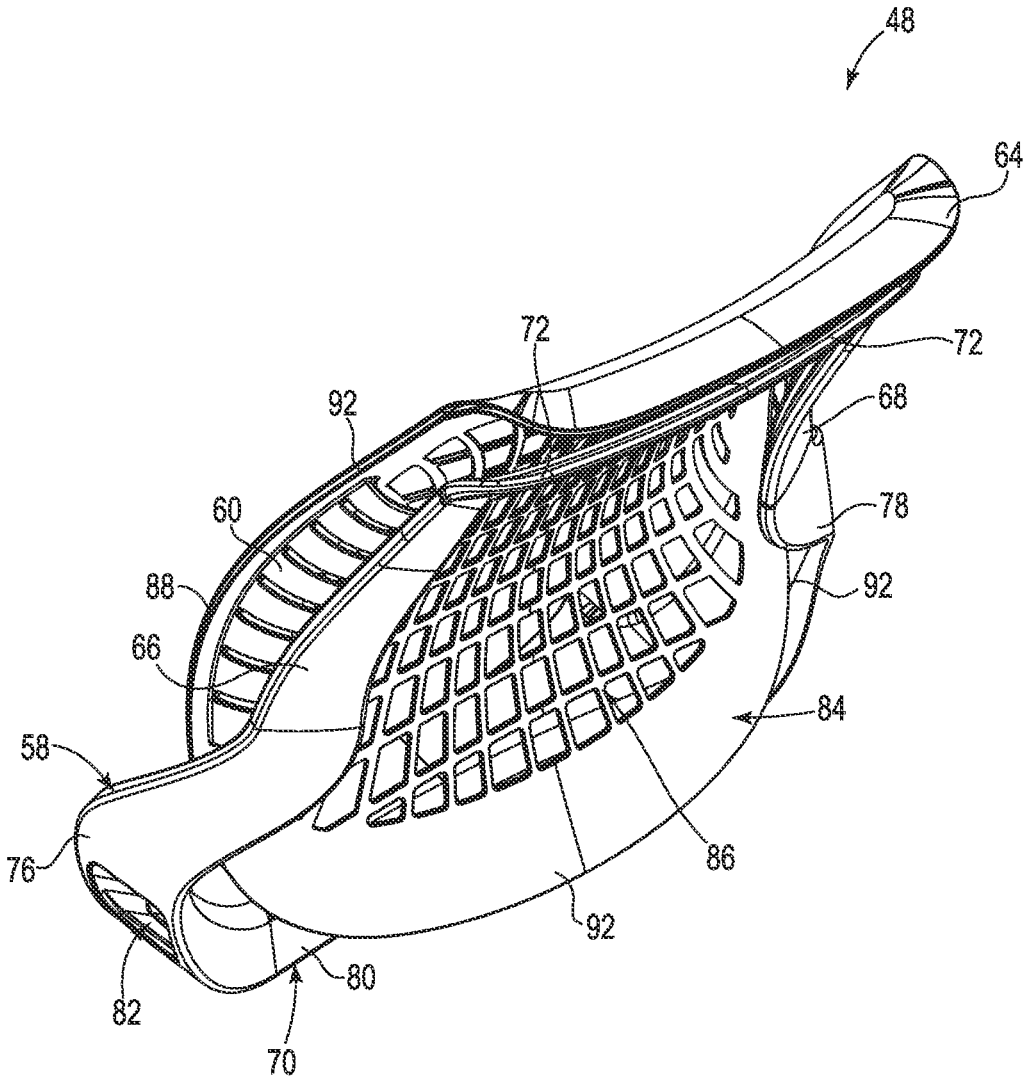
FIG. 6 is a diagram illustrating a rear top perspective view of the back of FIG. 4, according to some embodiments.
Figure 7:
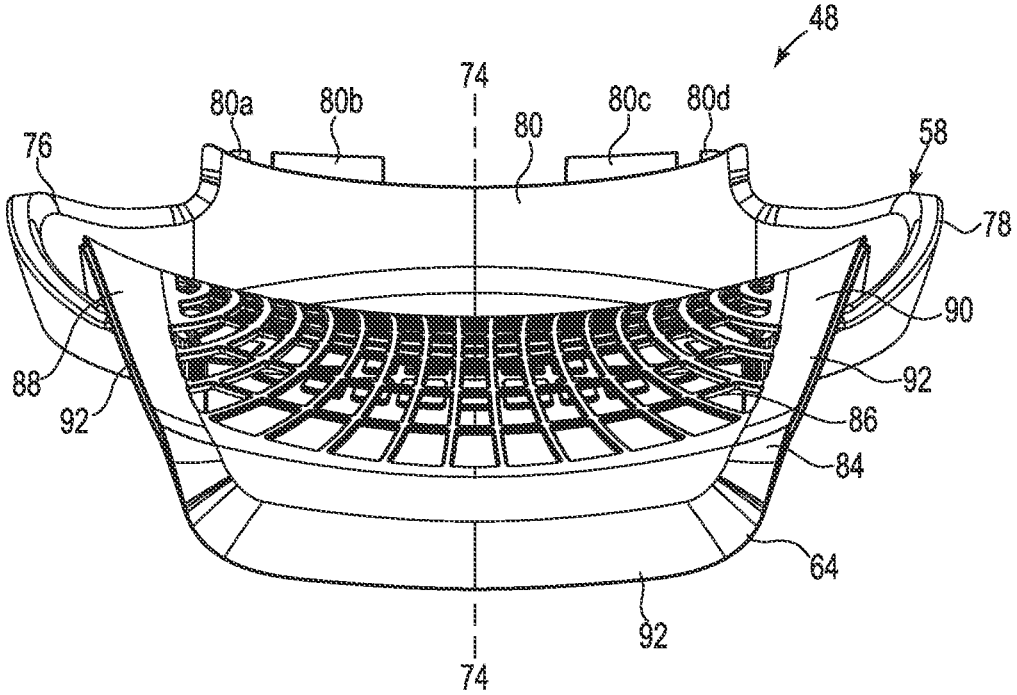
FIG. 7 is a diagram illustrating a top view of the back of FIG. 4, according to some embodiments.

FIGS. 4-7 are diagrams illustrating the back 48 of the chair 40, according to some embodiments. FIG. 4 is a diagram illustrating a rear perspective view of the back 48, according to some embodiments. FIG. 5 is a diagram illustrating a rear exploded view of the back 48, according to some embodiments. FIG. 6 is a diagram illustrating a rear top perspective view of the back 48, according to some embodiments. FIG. 7 is a diagram illustrating a top view of the back 48, according to some embodiments. As shown, the first and second flex wings 60 and 62 secure the back support 64 to the upright frame 58 and flex in response to application of a back force by the a user.

In some embodiments, the upright frame 58 that is illustrated in FIGS. 4-7 is substantially rigid and includes a first back upright 66, a second back upright 68, a bottom transverse member 70, and a top transverse member 72. A shown, the upright frame 58 is a closed loop frame that is substantially rectangular, where the first back upright 66 is substantially rigid and situated at the first frame side 58*a* and the second back upright 68 is substantially rigid and situated at the second frame side 58*b*. In some embodiments, the upright frame 58 is formed from cast aluminum. In some embodiments, the upright frame 58 is formed from molded plastic.

In some embodiments, the upright frame 58 includes the first back upright 66, the second back upright 68, and the bottom transverse member 70, but not the top transverse member 72, to form a U-shaped upright frame 58. In some embodiments, the upright frame 58 includes the first back upright 66 and the second back upright 68 to form an H-shaped upright frame 58. In some embodiments, the upright frame 58 includes the first back upright 66 and the second back upright 68 secured directly to the hub 44 or directly to the base 42. In some embodiments, the upright frame 58 includes the first back upright 66 and the second back upright 68 positioned at an angle from the center line 74 of the back 48 to provide a Y-shaped upright frame 58. In some embodiments, each of the first back upright 66 and the second back upright 68 includes a lumbar support adjustment track for receiving an adjustable lumbar support.

In the upright frame 58 that is illustrated in FIGS. 4-7, the bottom transverse member 70 is substantially rigid and secured to the hub 44, which secures the upright frame 58 to the hub 44. The bottom transverse member 70 includes first and second corner portions 76 and 78 and a bottom portion 80 that includes back frame inserts 80*a*-80*d* (shown in FIG. 7). The bottom transverse member 70 is secured to the hub 44 by inserting and securing the back frame inserts 80*a*-80*d* in the hub 44. In some embodiments, each of the corner portions 76 and 78 includes an arm receiving opening, such as arm receiving opening 82, for engaging and securing the armrests 50*a* and 50*b* to the upright frame 58.

The first back upright 66 is attached to the second back upright 68 by the bottom transverse member 70, such that the first back upright 66, the second back upright 68, and the bottom transverse member 70 form a U-shaped support. The first back upright 66 is secured to the first corner portion 76 and the second back upright 68 is secured to the second corner portion 78. In some embodiments, the first back upright 66, the second back upright 68, and the bottom transverse member 70 are integrally formed, i.e., as a single, monolithic piece. In some embodiments, the first back upright 66, the second back upright 68, and the bottom transverse member 70 are integrally formed in the same manufacturing process step. In some embodiments, the first back upright 66, the second back upright 68, and the bottom transverse member 70 are molded as a single, monolithic piece. In some embodiments, the first back upright 66, the second back upright 68, and the bottom transverse member 70 are separate pieces that are secured together, such as with one or more of adhesives, welding, fasteners, and mechanical engagement with each other.

The top transverse member 72 is substantially rigid and secured to the first back upright 66 and the second back upright 68. Where, the first back upright 66, the second back upright 68, the bottom transverse member 70, and the top transverse member 72 form the closed loop upright frame 58. In some embodiments, the first back upright 66, the second back upright 68, the bottom transverse member 70, and the top transverse member 72 are integrally formed, i.e., as a single, monolithic piece. In some embodiments, the first back upright 66, the second back upright 68, the bottom transverse member 70, and the top transverse member 72 are integrally formed in the same manufacturing process step. In some embodiments, the first back upright 66, the second back upright 68, the bottom transverse member 70, and the top transverse member 72 are molded as a single, monolithic piece. In some embodiments, two or more of the first back upright 66, the second back upright 68, the bottom transverse member 70, and the top transverse member 72 are separate pieces that are secured together, such as with one or more of adhesives, welding, fasteners, and mechanical engagement with each other.

The back support 64 is substantially flexible and has an outer region 84 and a central region 86. The outer region 84 includes a first side portion 88 and a second side portion 90. In some embodiments, the back support 64 is integrally formed, i.e., as a single, monolithic piece. In some embodiments, the back support 64 includes separate pieces that are secured together, such as with one or more of adhesives, welding, fasteners, and mechanical engagement with each other. In some embodiments, the back support 64 is formed of a flexible material, such as a thermoplastic. In some embodiments, the back support 64 is formed of a flexible material, including a thermoplastic elastomer. In some embodiments, the back support 64 is formed of a molded plastic that flexes under the weight of the user. In some embodiments, the back support 64 is formed of a molded thermoplastic.

The outer region 84 defines a perimeter ring 92 and the central region 86 defines a plurality of apertures arranged in a grid pattern that, optionally, increases the flexibility of the back support 64 in the central region 86. The perimeter ring 92 includes the first side portion 88 and the second side portion 90. In some embodiments, the central region 86 includes a mesh material for supporting the user, where the mesh material is attached to the perimeter ring 92. In some embodiments, the back support 64 includes a knit upholstery for supporting the user, where the knit upholstery is attached to the perimeter ring 92. In some embodiments, the back support 64 includes a molded plastic ring carrier at the perimeter ring 92 and a mesh is secured to the molded plastic ring carrier.

The first and second flex wings 60 and 62 secure the back support 64 to the upright frame 58. The first flex wing 60 is attached to or part of the first side portion 88 of the back support 64, and the second flex wing 62 is attached to or part of the second side portion 90 of the back support 64. The first flex wing 60 includes first notches 94 defined along the length L1 of the first flex wing 60 and the second flex wing 62 includes second notches 96 defined along the length L2 of the second flex wing 62. The flexibility of the first and second flex wings 60 and 62 can be adjusted based on the number of first and second notches 94 and 96 per unit length. Also, the flexibility of the first and second flex wings 60 and 62 can be adjusted based on the thickness of the first and second flex wings 60 and 62. In some embodiments, the first and second flex wings 60 and 62 and the back support 64 are integrally formed, i.e., as a single, monolithic piece. In some embodiments the first and second flex wings 60 and 62 and the back support 64 are integrally formed in the same manufacturing process step. In some embodiments, the first and second flex wings 60 and 62 and the back support 64 are molded as a single, monolithic piece. In some embodiments, the first and second flex wings 60 and 62 are separate pieces attached to the back support 64, such as with one or more of adhesives, welding, fasteners, and mechanical engagement with the back support 64.

Figure 8:
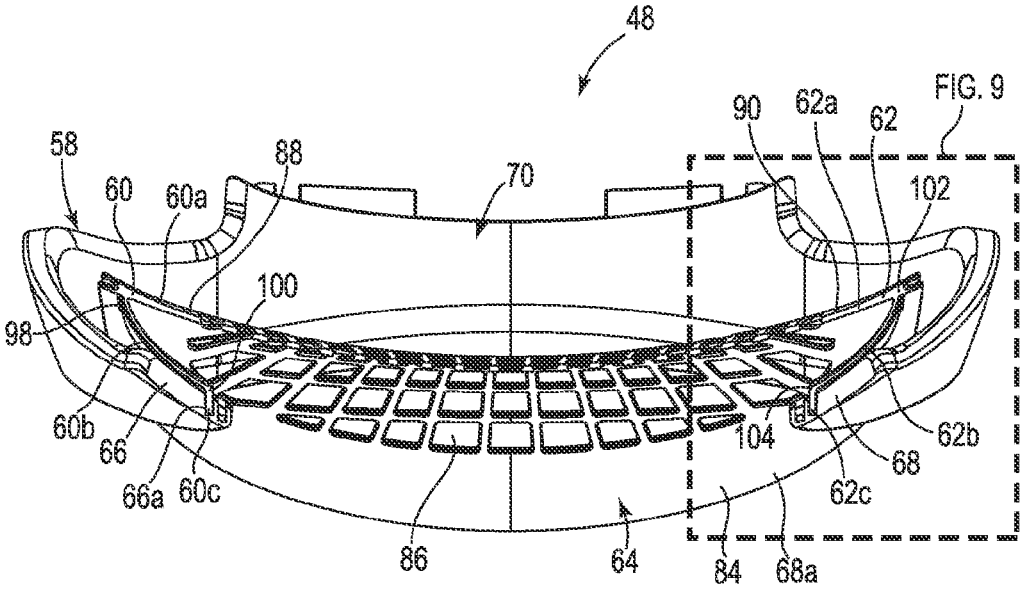
FIG. 8 is a cross-section diagram illustrating the back of FIG. 4 taken along the line 8-8 in FIG. 3, according to some embodiments.
Figure 9:
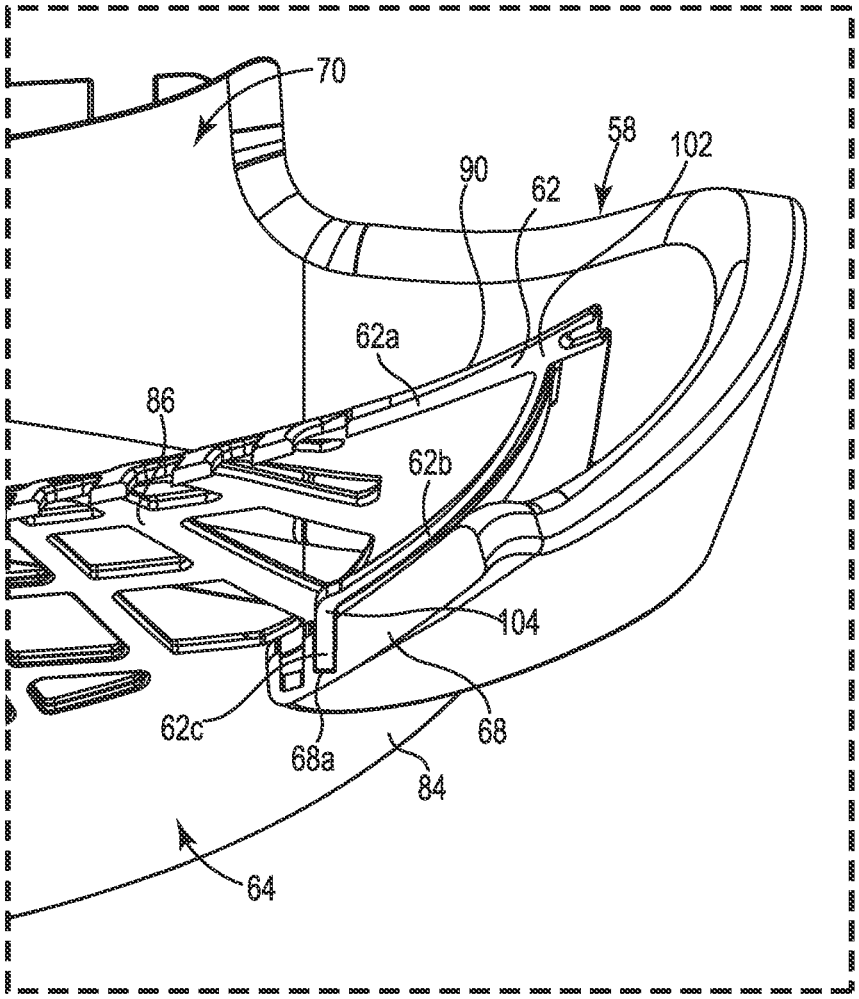
FIG. 9 is an enlarged diagram illustrating one side of the back of FIG. 8, according to some embodiments.

FIG. 8 is a cross-section diagram illustrating the back 48 taken along the line 8-8 in FIG. 3, according to some embodiments, and FIG. 9 is an enlarged diagram illustrating one side of the back 48 as indicated in FIG. 8, according to some embodiments. The back 48 includes the upright frame 58, including the first back upright 66, the second back upright 68, and the bottom transverse member 70; the back support 64, including the outer region 84, the first side portion 88, the second side portion 90, and the central region 86; and the first and second flex wings 60 and 62.

The first and second flex wings 60 and 62 are each Y-shaped or, alternatively, lambda-shaped resilient pieces that flex during user engagement with the back support 64. The first flex wing 60 includes a first front portion 60*a*, a first web portion 60*b*, and a first back portion 60*c*. The second flex wing 62 includes a second front portion 62*a*, a second web portion 62*b*, and a second back portion 62*c*. In some embodiments, the first front portion 60*a*, the first web portion 60*b*, and the first back portion 60*c* are integrally formed, i.e., as a single, monolithic piece. In some embodiments, the second front portion 62*a*, the second web portion 62*b*, and the second back portion 62*c* are integrally formed, i.e., as a single, monolithic piece. In some embodiments, the first front portion 60*a*, the first web portion 60*b*, and the first back portion 60*c* are integrally formed in the same manufacturing process step. In some embodiments, the second front portion 62*a*, the second web portion 62*b*, and the second back portion 62*c* are integrally formed in the same manufacturing process step. In some embodiments, the first front portion 60*a*, the first web portion 60*b*, and the first back portion 60*c* are formed of a resilient flexible material, such as a molded plastic. In some embodiments, the second front portion 62*a*, the second web portion 62*b*, and the second back portion 62*c* are formed of a resilient flexible material, such as a molded plastic. In some embodiments, two or more of the first front portion 60*a*, the first web portion 60*b*, and the first back portion 60*c* are separate pieces attached together, such as with one or more of adhesives, welding, fasteners, and mechanical engagement. In some embodiments, two or more of the second front portion 62*a*, the second web portion 62*b*, and the second back portion 62*c* are separate pieces attached together, such as with one or more of adhesives, welding, fasteners, and mechanical engagement.

The first and second flex wings 60 and 62 secure the back support 64 to the upright frame 58. The first front portion 60*a* of the first flex wing 60 is attached to or part of the first side portion 88 of the back support 64, and the second front portion 62*a* of the second flex wing 62 is attached to or part of the second side portion 90 of the back support 64. Also, the first back portion 60*c* is inserted and secured in a first receiving channel 66*a* of the first back upright 66 to secure the first flex wing 60 to the first back upright 66, and the second back portion 62*c* is inserted and secured in a second receiving channel 68*a* of the second back upright 68 to secure the second flex wing 62 to the second back upright 68.

The first and second flex wings 60 and 62 flex in response to the weight of a user. The first flex wing 60 includes a first flex region 98 defined by the first front portion 60*a* and the first web portion 60*b* and a second flex region 100 defined by the first web portion 60*b* and the first back portion 60*c*. The second flex wing 62 includes a third flex region 102 defined by the second front portion 62*a* and the second web portion 62*b*, and a fourth flex region 104 defined by the second web portion 62*b* and the second back portion 62*c*. In some embodiments, the first and second web portions 60*b* and 62*b* extend away from the first and second front portions 60*a* and 62*a*, respectively, at an acute angle. In some embodiments, the first and second web portions 60*b* and 62*b* extend away from the first and second front portions 60*a* and 62*a*, respectively, at an angle in the range of 20-80 degrees. In some embodiments, the first and second web portions 60*b* and 62*b* extend away from the first and second back portions 60*c* and 62*c*, respectively, at an obtuse angle. In other embodiments, the first and second web portions 60*b* and 62*b* extend away from the first and second back portions 60*c* and 62*c*, respectively, at an acute angle.

Figure 10A:
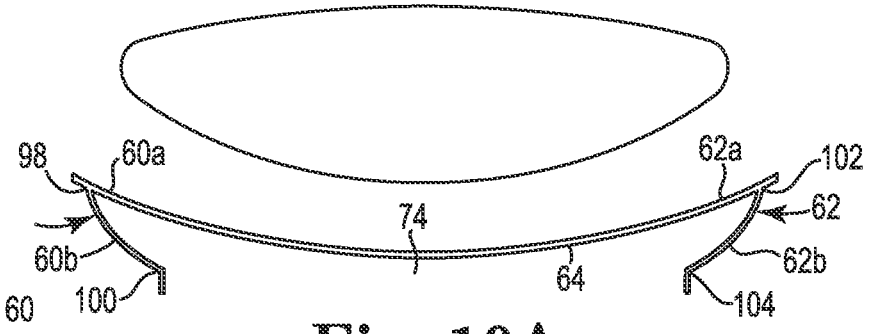
FIGS. 10A-10D are diagrams illustrating the flexing action of the first and second flex wings, according to some embodiments.
Figure 10B:
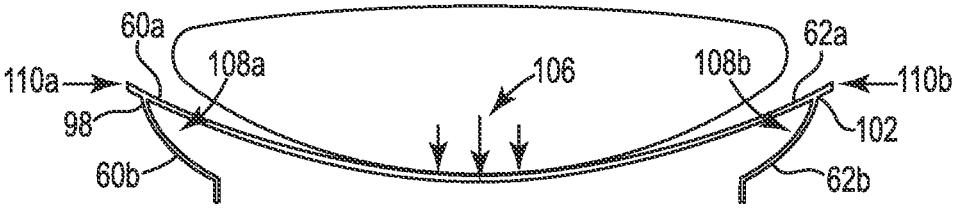

FIGS. 10A-10D are diagrams illustrating the flexing action of the first and second flex wings 60 and 02, according to some embodiments. The first and second flex wings 60 and 62 flex in response to a user leaning back in the chair 40 and applying weight to the back support 64. As shown in FIG. 10B, as the back support 64 bows under user weight, indicated by arrows at 106, the front portions 60*a* and 62*a* flex inwardly, indicated by arrows at 108*a* and 108*b*, toward the web portions 60*b* and 62*b* and about the first flex region 98 and the third flex region 102. Also, edges of the first and second flex wings 60 and 62 move toward the center line 74 of the back 48, indicated by arrows 110*a* and 110*b*. In some embodiments, a concentrated center load flexes the first and second flex wings 60 and 62 such that the back support 64 embraces the user.

Figure 10C:
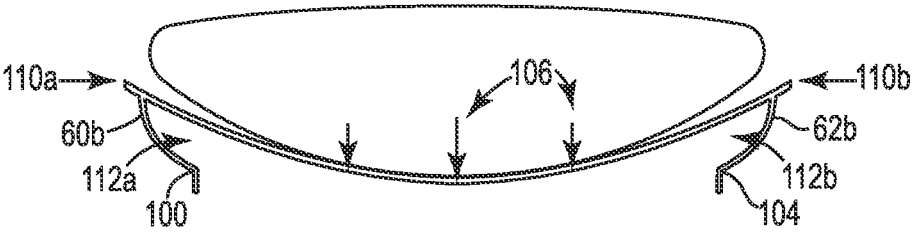

As shown in FIG. 10C, as the user further leans back in the chair 40 and applies more weight, the user's weight, indicated by the arrows at 106, is spread across the back support 64 and the back support 64 further bows under the user's weight. The web portions 60*b* and 62*b* flex inwardly, indicated by arrows at 112*a* and 112*b*, toward the center line 74 of the back support 64 and about the second flex region 100 and the fourth flex region 104. Also, the edges of the first and second flex wings 60 and 62 move further toward the center line 74 of the back 48, indicated by the arrows 110*a* and 110*b* in FIG. 10C.

Figure 10D:
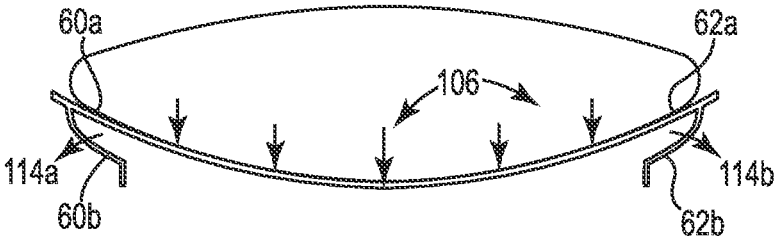

As shown in FIG. 10D, as more of the user's weight is spread over a wider area of the back support 64, indicated by the arrows at 106, the first and second flex wings 60 and 62 flatten out, such that the front portions 60*a* and 62*a* flex or fold toward the web portions 60*b* and 62*b* and the web portions 60*b* and 62*b* flex or fold toward the first and second back uprights 66 and 68, indicated by arrows at 114*a* and 114*b*. Also, the edges of the first and second flex wings 60 and 62 move away from the center line 74 of the back 48 to create more support in the middle of the back support 64. In some embodiments, the front portions 60*a* and 60*b* flex or fold against the web portions 60*b* and 62*b* to arrest further deformation of the first and second flex wings 60 and 62. In some embodiments, the first and second flex wings 60 and 62 experience flexing at the flex regions 98, 100, 102, and 104 and deformation throughout the web portions 60*b* and 62*b*. In some embodiments, the flex regions 98, 100, 102, and 104 are reinforced against deformation such that the web portions 60*b* and 62*b* deform more than the flex regions 98, 100, 102, and 104 or substantially all of the deformation is in the web portions 60*b* and 62*b*.

Figure 11:
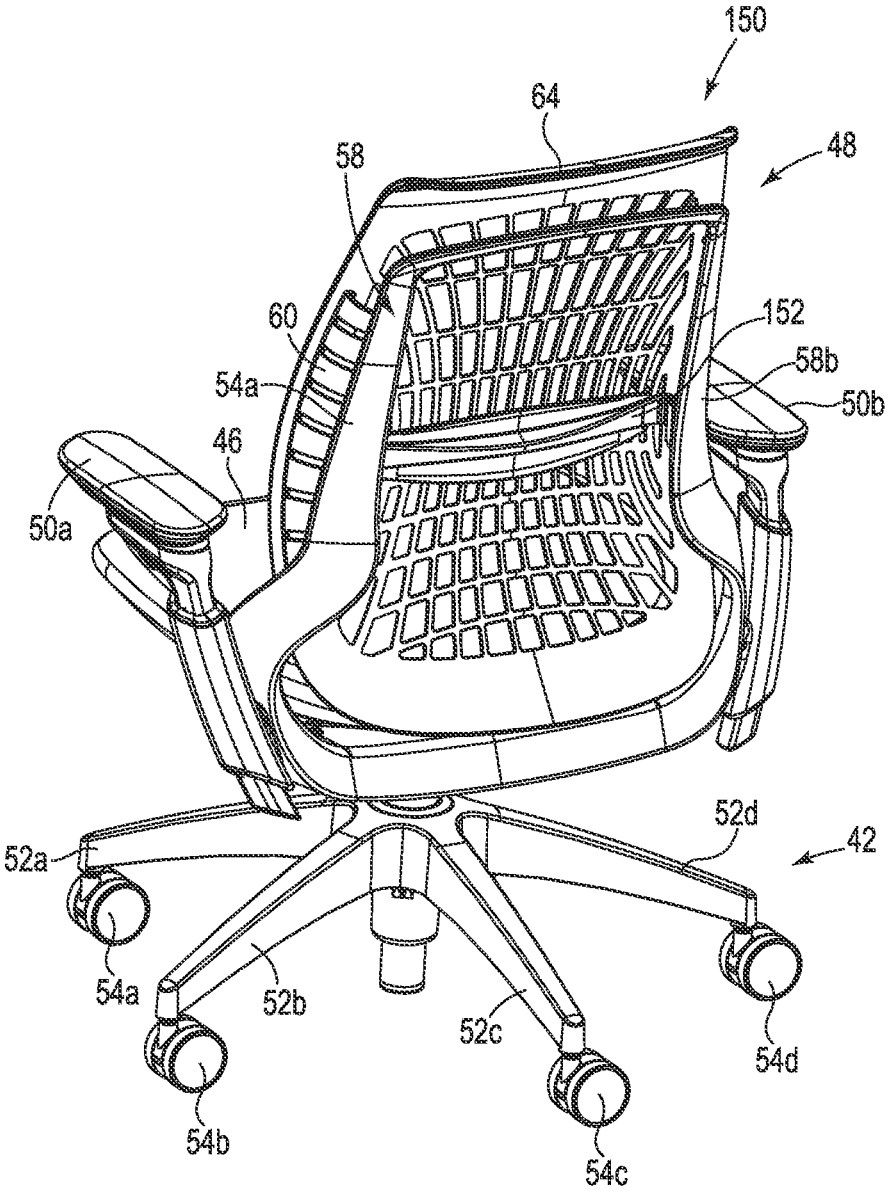
FIG. 11 is a diagram illustrating a perspective view from the back of a chair including a lumbar member, according to some embodiments.

FIG. 11 is a diagram illustrating a perspective view from the back of a chair 150 including a lumbar member 152, according to some embodiments. The chair 150 is similar to the chair 40, with the exception that the chair 150 includes the lumbar member 152.

The chair 150 includes the same or similar components as the chair 40 such that like numerals point to like components and the description above of the chair 40 applies to the components of the chair 150. For reference, the chair 150 includes the base 42, the hub 44, the seat 46, the back 48, and the armrests 50*a* and 50*b*, where the base 42 supports the chair 150, including the hub 44, the seat 46, and the back 48, on the surface. Also, the base 42 includes the leg supports 52*a*-52*e*, where each of the leg supports 52*a*-52*e* includes the corresponding wheel 54*a*-54*e* for rolling the chair 40 on the surface. The seat 46 supports the body of the user and the armrests 50*a* and 50*b* support the arms of the user.

The back 48 supports the back of the user and flexes or bends to accommodate movements of the user. The back 48 includes the upright frame 58, the first and second flex wings 60 and 62, and the back support 64. The upright frame 58 is supported by the base 42 and includes the first frame side 58*a* and the second frame side 58*b*. The back support 64 is attached to the upright frame 58 at the first frame side 58*a* and the second frame side 58*b* via the first and second flex wings 60 and 62. The first flex wing 60 is situated between the first frame side 58*a* and the back support 64 and the second flex wing 62 is situated between the second frame side 58*b* and the back support 64.

The lumbar member 152 provides localized support to the back support 64, such as in the lower back region of the user. The lumbar member 152 is slidably engaged between the first frame side 58*a* and the second frame side 58*b* to slide vertically upward and downward and locally adjust support along the back 48. In some embodiments, the lumbar member 152 includes a pad to engage the back support 64 and provide forward pressure on the back support 64 to further support the back of the user.

Figure 12:
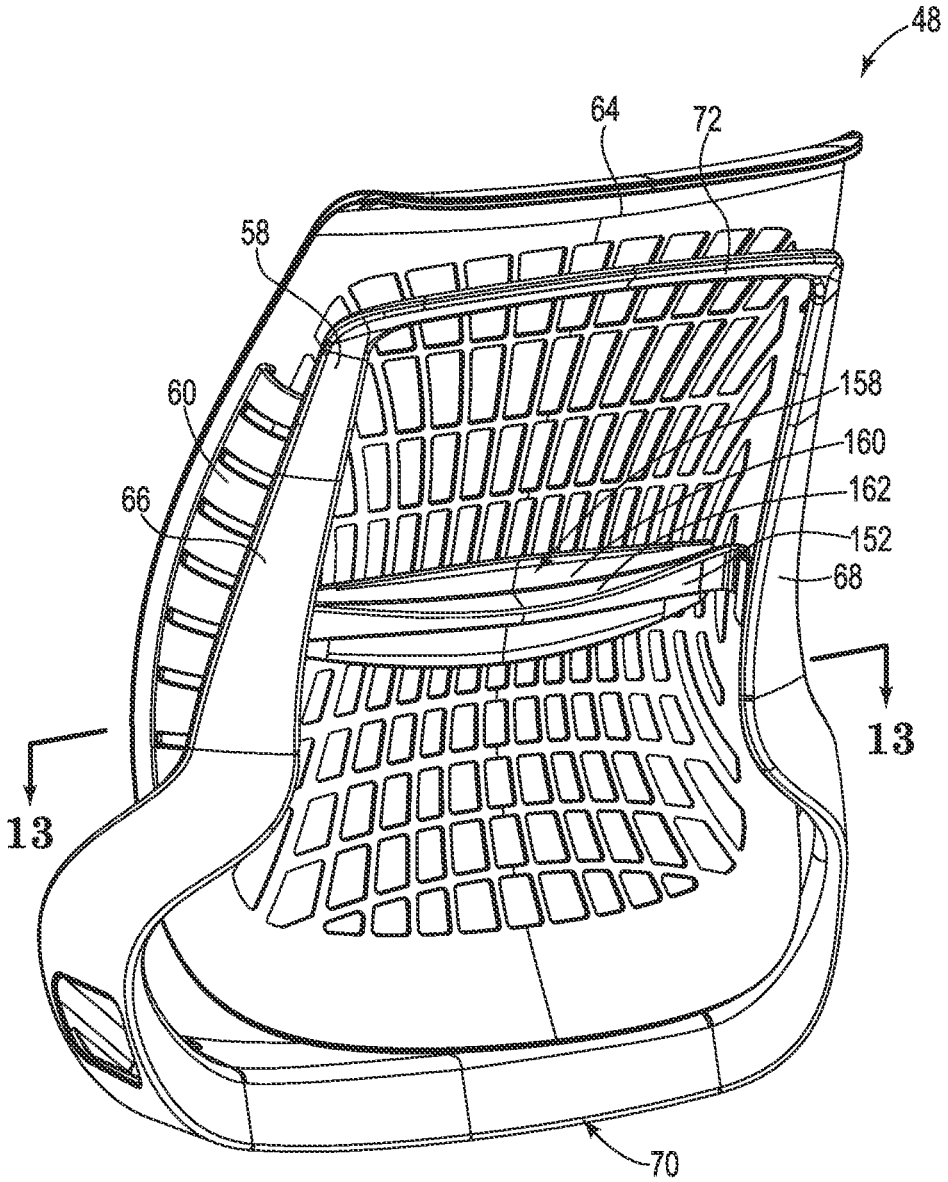
FIG. 12 is a diagram illustrating a perspective view of the back of FIG. 4 including a lumbar member, according to some embodiments.

FIG. 12 is a diagram illustrating a perspective view of the back 48 including the lumbar member 152, according to some embodiments. The back 48 includes the upright frame 58, the first and second flex wings 60 and 62, and the back support 64. In some embodiments, the upright frame 58 includes the first back upright 66, the second back upright 68, the bottom transverse member 70, and the top transverse member 72.

The lumbar member 152 is slidably engaged between the first back upright 66 and the second back upright 68 to slide vertically upward and downward and locally adjust support along the back 48. In some embodiments, the lumbar member 152 is slidably engaged with the first back upright 66 and the second back upright 68. In some embodiments, the lumbar member 152 is slidably engaged with the first flex wing 60 and the second flex wing 62.

Figure 13:
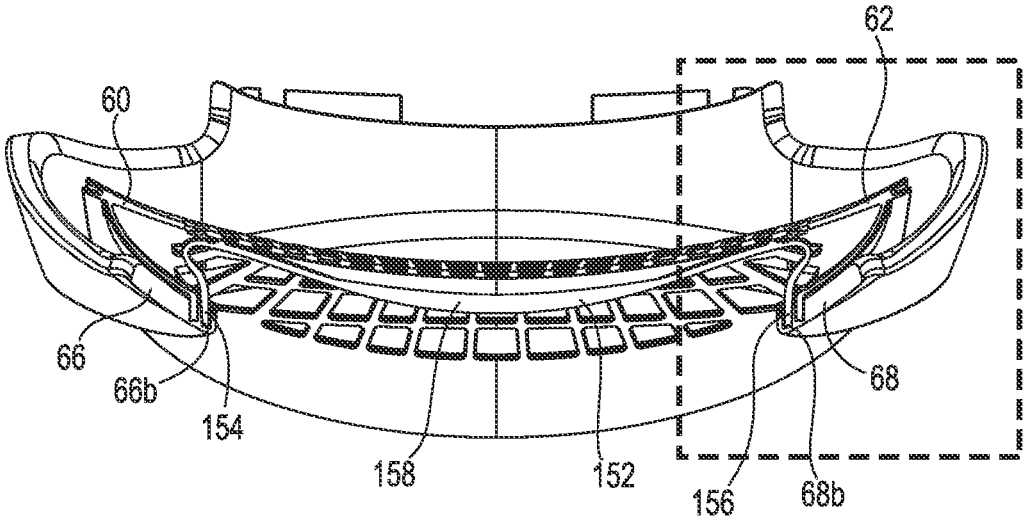
FIG. 13 is a diagram illustrating a cross-section view taken along the line 13-13 in FIG. 12, according to some embodiments.
Figure 14:
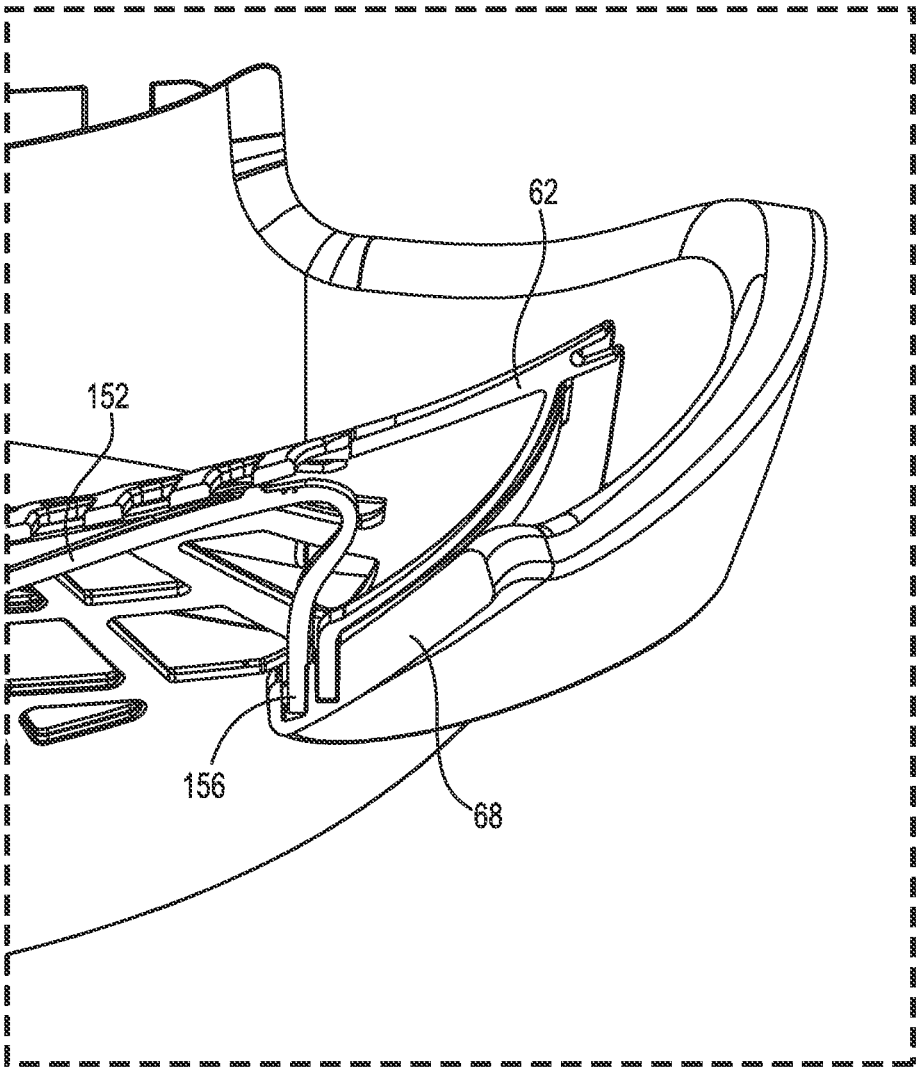
FIG. 14 is a diagram illustrating an enlarged view of one side of the back of FIG. 13, according to some embodiments.

FIGS. 13 and 14 are diagrams illustrating the lumbar member 152 slidably engaged with the first back upright 66 and the second back upright 68. FIG. 13 is a diagram illustrating a cross-section view taken along the line 13-13 in FIG. 12, according to some embodiments. FIG. 14 is a diagram illustrating an enlarged view of one side of the back 48, as indicated in FIG. 13, according to some embodiments. The lumbar member 152 includes a first end 154, a second end 156, and a central support region 158. In some embodiments, the central support region 158 includes a first cross-member 160 and a second cross-member 162 that is substantially perpendicular to the first cross-member 160, as shown in FIG. 12.

In some embodiments, the first end 154, the second end 156, and the central support region 158, including the first cross-member 160 and the second cross-member 162, are integrally formed, i.e., as a single, monolithic piece. In some embodiments, the first end 154, the second end 156, and the central support region 158, including the first cross-member 160 and the second cross-member 162, are integrally formed in the same manufacturing process step. In some embodiments, the first end 154, the second end 156, and the central support region 158, including the first cross-member 160 and the second cross-member 162, are formed of a resilient flexible material, such as a molded plastic. In some embodiments, two or more of the first end 154, the second end 156, the first cross-member 160, and the second cross-member 162 are separate pieces attached together, such as with one or more of adhesives, welding, fasteners, and mechanical engagement.

The first back upright 66 includes a first lumbar track 66*b* for receiving the first end 154 of the lumbar member 152 and the second back upright 68 includes a second lumbar track 68*b* for receiving the second end 156 of the lumbar member 152. The first end 154 is inserted in and slidably engaged in the first lumbar track 66*b* and the second end 156 is inserted in and slidably engaged in the second lumbar track 68*b*. The lumbar member 152 extends between the first back upright 66 and the second back upright 68 to provide local resistance to compression of the first flex wing 60 and the second flex wing 62, and the lumbar member 152 slides vertically upward and downward to locally adjust support along the back 48. In some embodiments, the lumbar member 152 further includes a pad to engage the back support 64 and provide forward pressure on the back support 64.

In some embodiments, the first flex wing 60 includes a first lumbar track for receiving the first end 154 of the lumbar member 152 and the second flex wing 62 includes a second lumbar track for receiving the second end 156 of the lumbar member 152. The first end 154 is inserted in and slidably engaged in the first lumbar track of the first flex wing 60 and the second end 156 is inserted in and slidably engaged in the second lumbar track of the second flex wing 62. The lumbar member 152 extends between the first flex wing 60 and the second flex wing 62 to provide local resistance to compression of the first flex wing 60 and the second flex wing 62, and the lumbar member 152 slides vertically upward and downward to locally adjust support along the back 48. In some embodiments, the lumbar member 152 further includes a pad to engage the back support 64 and provide forward pressure on the back support 64.

In some embodiments, the lumbar member 152 does not include the central support region 158, such that the lumbar member 152 includes the first end 154 and the second end 156 without the interconnecting central support region 158. In these embodiments, the first end 154 is inserted in and slidably engaged in a first lumbar track in one of the first back upright 66 and the first flex wing 60 to provide local resistance to compression of the first flex wing 60, and the second end 156 is inserted in and slidably engaged in a second lumbar track in one of the second back upright 68 and the second flex wing 62 to provide local resistance to compression of the second flex wing 62.

Figure 15:
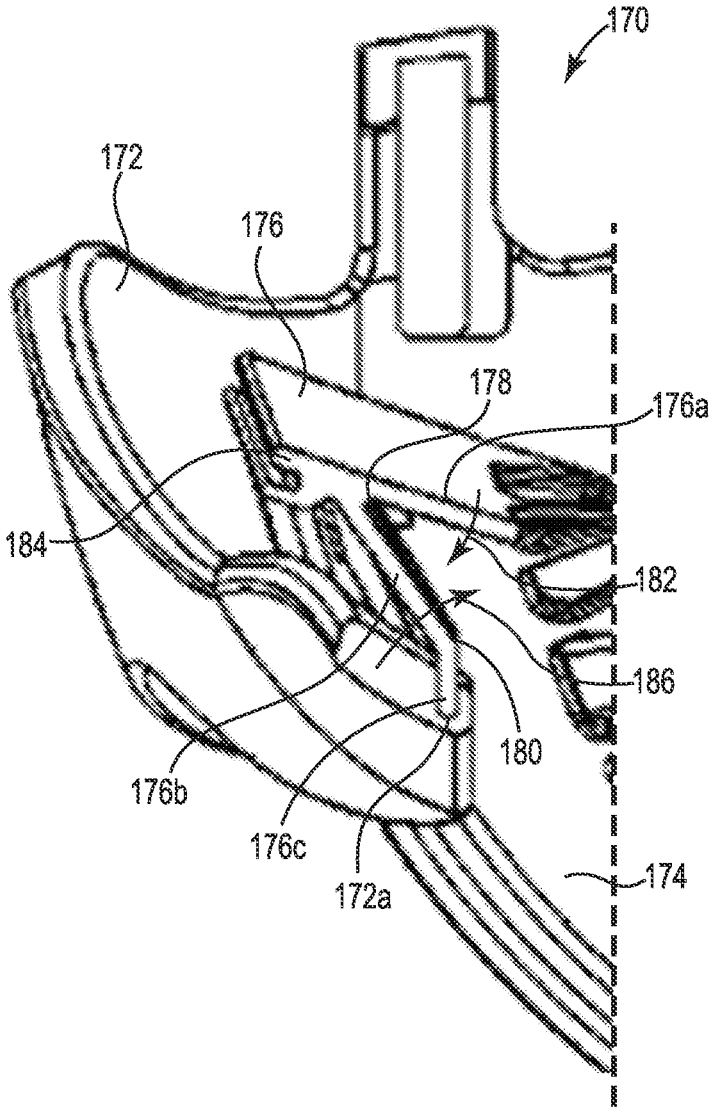
FIG. 15 is a diagram illustrating an enlarged cross-section view of one side of a back that includes a Y-shaped flex wing, according to some embodiments.

FIG. 15 is a diagram illustrating an enlarged cross-section view of one side of a back 170 that includes an upright frame 172, a back support 174, and a flex wing 176, according to some embodiments. The flex wing 176 is one flex wing of a pair of flex wings similar to the first and second flex wings 60 and 62, with the exception that the flex wing 176 and its pair have different shapes than the first and second flex wings 60 and 62. The flex wing 176 and its pair are mirror images of each other, but otherwise similar, such that they can both be described with reference to the flex wing 176.

The flex wing 176 is similar to each of the first and second flex wings 60 and 62, except for the shape, such that the description provided above for the first and second flex wings 60 and 62 applies to the flex wing 176. Also, the back 170 is similar to the back 48, the upright frame 172 is similar to the upright frame 58, and the back support 174 is similar to the back support 64, such that the description provided above for the back 48, the upright frame 58, and the back support 64 applies to the back 170, the upright frame 172, and the back support 174.

The flex wing 176 is a Y-shaped or, alternatively, lambda-shaped resilient piece that flexes as user weight is applied to the back support 174. The flex wing 176 includes a front portion 176*a*, a web portion 176*b*, and a back portion 176*c*, where the web portion 176*b* is straighter than each of the web portions 60*b* and 62*b* of the first and second flex wings 60 and 62.

The flex wing 176 and its pair secure the back support 174 to the upright frame 172. The front portion 176*a* is attached to or part of the back support 174 and the back portion 176*c* is inserted in and secured to a receiving channel 172*a* of the upright frame 172.

The flex wing 176 flexes in response to the weight of a user. The flex wing 176 includes a first flex region 178 defined by the front portion 176*a* and the web portion 176*b* and a second flex region 180 defined by the web portion 176*b* and the back portion 176*c*. In some embodiments, the web portion 176*b* extends away from the front portion 176*a* at an acute angle. In some embodiments, the web portion 176*b* extends away from the front portion 176*a* at an angle in the range of 20-80 degrees. In some embodiments, the web portion 176*b* extends away from the back portion 176*c* at an obtuse angle. In other embodiments, the web portion 176*b* extends away from the back portion 176*c* at an acute angle.

The flex wing 176 flexes in response to a user leaning back and applying weight to the back support 174. The flex wing 176 flexes similar to the first and second flex wings 60 and 62 as described in reference to FIGS. 10A-10D. Initially, as the back support 174 bows under user weight, the front portion 176*a* flexes inwardly, indicated by an arrow at 182, toward the web portion 176*b* and about the first flex region 178. Also, the edge 184 of the flex wing 176 moves toward the center of the back 170.

Next, as the user further leans back and applies more weight, the user's weight is spread across the back support 174 and the back support 174 bows further under the user's weight. The web portion 176*b* flexes inwardly, indicated by the arrow 186, toward the center of the back support 174 and about the second flex region 180. Also, the edge 184 of the flex wing 176 moves further toward the center of the back 170.

Next, as more of the user's weight is spread over a wider area of the back support 174, the flex wing 176 flattens out, such that the front portion 176*a* flexes or folds toward the web portion 176*b* and the web portion 176*b* flexes or folds toward the back support 174 and the upright frame 58. Also, the edge 184 of the flex wing 176 moves away from the center of the back 170 to create more support in the middle of the back support 174.

Figure 16:
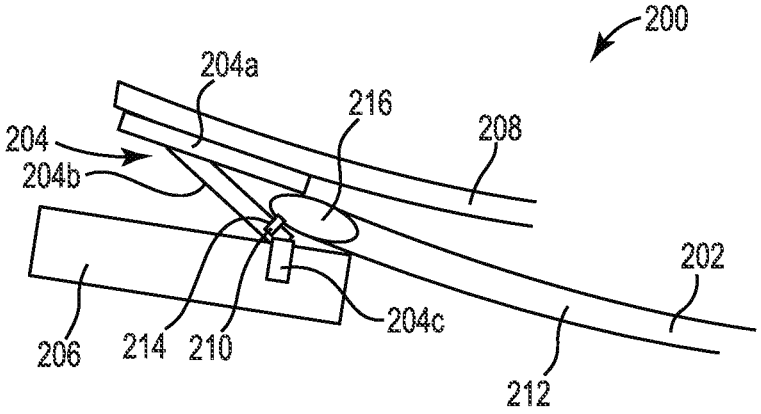
FIG. 16 is a diagram illustrating one side of a back that includes a lumbar member slidably engaged with a flex wing, according to some embodiments.

FIG. 16 is a diagram illustrating one side of a back 200 that includes a lumbar member 202 slidably engaged with a flex wing 204 to slide vertically upward and downward on the back 200, according to some embodiments. Also, the lumbar member 202 locally limits further compression of the flex wing 204, after the flex wing 204 has been sufficiently flexed. The back 200 includes the lumbar member 202, the flex wing 204, an upright frame 206, and a back support 208.

The one side of the back 200 that is shown in FIG. 16 is a mirror image of the other side of the back 200, but otherwise similar, such that they can both be described with reference to the one side of the back 200 shown in FIG. 16. Also, the flex wing 204 is one of a pair of flex wings that are mirror images of each other, but otherwise similar, such that they can both be described with reference to the flex wing 204. In addition, an end 210 of the lumbar member 202 is one of a pair of ends of the lumbar member 202, which are mirror images of each other, but otherwise similar, such that they can both be described with reference to the one end 210.

In some embodiments, the back 200 is similar to the back 48, the flex wing 204 is similar to each of the first and second flex wings 60 and 62, the upright frame 206 is similar to the upright frame 58, and the back support 208 is similar to the back support 64, such that the description provided above for the back 48, the first and second flex wings 60 and 62, the upright frame 58, and the back support 64 applies to the back 200, the flex wing 204, the upright frame 206, and the back support 208. In some embodiments, the lumbar member 202 is similar to the lumbar member 152.

The lumbar member 202 includes the end 210 and a central support region 212. The flex wing 204 includes a front portion 204*a*, a web portion 204*b*, and a back portion 204*c*. In addition, the flex wing 204 includes a lumbar track 214 for receiving the end 210 of the lumbar member 202. The end 210 is inserted in and slidably engaged in the lumbar track 214. The lumbar member 202 slides vertically upward and downward in the lumbar track 214 to locally adjust support along the back 200.

In some embodiments, the lumbar member 202 further includes a protrusion 216 that extends from the lumbar member 202 to between the front portion 204*a* and the web portion 204*b* of the flex wing 204. As the front portion 204*a* flexes toward the web portion 204*b*, the protrusion 216 interferes with the flexure of the front portion 204*a* and the web portion 204*b* to limit further compression of the flex wing 204.

Figure 17:
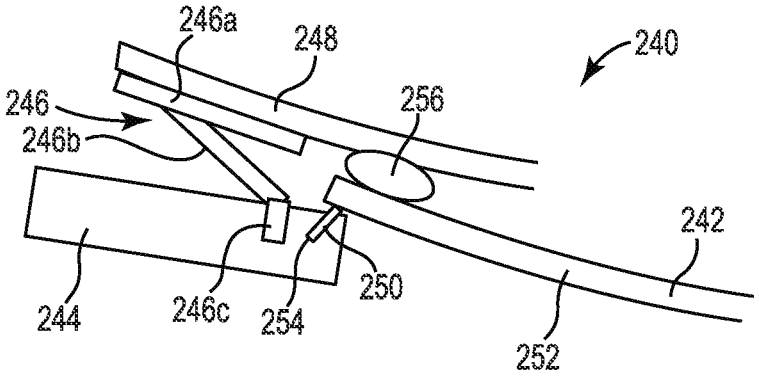
FIG. 17 is a diagram illustrating one side of a back that includes a lumbar member slidably engaged with an upright frame, according to some embodiments.

FIG. 17 is a diagram illustrating one side of a back 240 that includes a lumbar member 242 slidably engaged with an upright frame 244 to slide vertically upward and downward on the back 240, according to some embodiments. The lumbar member 242 locally limits further compression of the flex wings including flex wing 246, after the flex wing 246 has been sufficiently flexed. The back 240 includes the lumbar member 242, the upright frame 244, the flex wing 246, and a back support 248.

The one side of the back 240 that is shown in FIG. 17 is a mirror image of the other side of the back 240, but otherwise similar, such that they can both be described with reference to the one side of the back 240 shown in FIG. 17. Also, the flex wing 246 is one of a pair of flex wings that are mirror images of each other, but otherwise similar, such that they can both be described with reference to the flex wing 246. In addition, an end 250 of the lumbar member 242 is one of a pair of ends of the lumbar member 242, which are mirror images of each other, but otherwise similar, such that they can both be described with reference to the end 250.

In some embodiments, the back 240 is similar to the back 48, the flex wing 246 is similar to each of the first and second flex wings 60 and 62, the upright frame 244 is similar to the upright frame 58, and the back support 248 is similar to the back support 64, such that the description provided above for the back 48, the first and second flex wings 60 and 62, the upright frame 58, and the back support 64 applies to the back 240, the flex wing 246, the upright frame 244, and the back support 248. In some embodiments, the lumbar member 242 is similar to the lumbar member 152.

The lumbar member 242 includes the end 250 and a central support region 252. The flex wing 246 includes a front portion 246*a*, a web portion 246*b*, and a back portion 246*c*. In addition, the upright frame 244 includes a lumbar track 254 for receiving the end 250 of the lumbar member 242. The end 250 is inserted in and slidably engaged in the lumbar track 254 of the upright frame 244. The lumbar member 242 slides vertically upward and downward in the lumbar track 254 to locally adjust support along the back 240.

In some embodiments, the lumbar member 242 further includes a protrusion 256 that extends from the lumbar member 242 toward the back support 248. As the front portion 246*a* flexes toward the web portion 246*b*, the protrusion 256 presses against the back support 248 and limits flexure and further compression of the flex wing 246. In some embodiments, the lumbar track is built into the lumbar member, such as lumbar member 202 and lumbar member 242, and a complementary slide feature is built into one of the flex wings and the upright frame.

Figure 18:
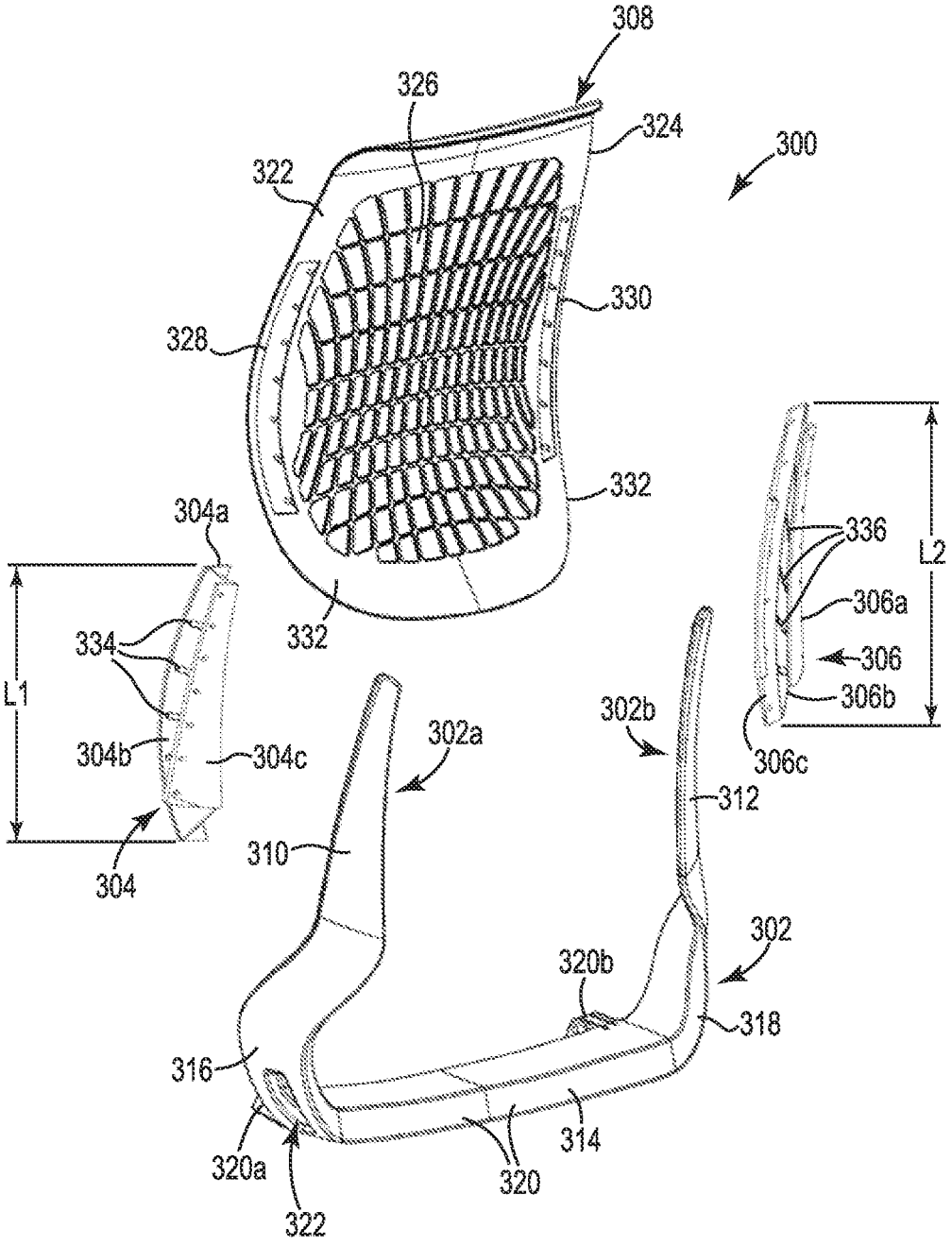
FIG. 18 is a diagram illustrating an exploded view of a back that includes a U-shaped upright frame and Z-shaped first and second flex wings, according to some embodiments.

FIG. 18 is a diagram illustrating an exploded view of a back 300 of a chair that includes a U-shaped upright frame 302 and Z-shaped first and second flex wings 304 and 306, according to some embodiments. The back 300 includes the upright frame 302, the first and second flex wings 304 and 306, and a back support 308. The first and second flex wings 304 and 306 are secured to the upright frame 302 and to the back support 308. The first and second flex wings 304 and 306 secure the back support 308 to the upright frame 302 and flex in response to the weight of a user.

The upright frame 302 is substantially rigid and includes a first back upright 310, a second back upright 312, and a bottom transverse member 314. The upright frame 302 is a U-shaped frame, where the first back upright 310 is substantially rigid and situated at the first frame side 302*a* and the second back upright 312 is substantially rigid and situated at the second frame side 302*b*. In some embodiments, the upright frame 302 is formed from cast aluminum. In some embodiments, the upright frame 302 is formed from molded plastic. In some embodiments, each of the first back upright 310 and the second back upright 312 includes a lumbar member track for receiving an adjustable lumbar member.

The bottom transverse member 314 includes first and second corner portions 316 and 318 and a bottom portion 320 that includes frame connectors 320*a* and 320*b*. In some embodiments, the bottom transverse member 314 is substantially rigid and secured to a hub, such as the hub 44, with the frame connectors 320*a* and 320*b*, which secures the upright frame 302 to the hub. In some embodiments, each of the first and second corner portions 316 and 318 includes an arm receiving opening, such as arm receiving opening 322, for engaging and securing armrests, such as the armrests 50*a* and 50*b*, to the upright frame 302.

The first back upright 310 is attached to the second back upright 312 by the bottom transverse member 314, such that the first back upright 310, the second back upright 312, and the bottom transverse member 314 form a U-shaped support. The first back upright 310 is secured to the first corner portion 316 and the second back upright 312 is secured to the second corner portion 318. In some embodiments, the first back upright 310, the second back upright 312, and the bottom transverse member 314 are integrally formed, i.e., as a single, monolithic piece. In some embodiments, the first back upright 310, the second back upright 312, and the bottom transverse member 314 are integrally formed in the same manufacturing process step. In some embodiments, the first back upright 310, the second back upright 312, and the bottom transverse member 314 are molded as a single, monolithic piece. In some embodiments, two or more of the first back upright 310, the second back upright 312, and the bottom transverse member 314 are separate pieces that are secured together, such as with one or more of adhesives, welding, fasteners, and mechanical engagement with each other.

The back support 308 is substantially flexible and has an outer region 324 and a central region 326. The outer region 324 includes a first side portion 328 and a second side portion 330. In some embodiments, the back support 308 is integrally formed, i.e., as a single, monolithic piece. In some embodiments, the back support 308 includes separate pieces that are secured together, such as with one or more of adhesives, welding, fasteners, and mechanical engagement with each other. In some embodiments, the back support 308 is formed of a flexible material, such as a thermoplastic. In some embodiments, the back support 308 is formed of a flexible material, including a thermoplastic elastomer. In some embodiments, the back support 308 is formed of a molded plastic that flexes under the weight of the user. In some embodiments, the back support 308 is formed of a molded thermoplastic.

The outer region 324 defines a perimeter ring 332 and the central region 326 defines a plurality of apertures arranged in a grid pattern that, optionally, increases the flexibility of the back support 308 in the central region 326. The perimeter ring 332 includes the first side portion 328 and the second side portion 330. In some embodiments, the central region 326 includes a mesh material for supporting the user, where the mesh material is attached to the perimeter ring 332. In some embodiments, the back support 308 includes a knit upholstery for supporting the user, where the knit upholstery is attached to the perimeter ring 332. In some embodiments, the back support 308 includes a molded plastic ring carrier at the perimeter ring 332 and a mesh is secured to the molded plastic ring carrier.

The first flex wing 304 is attached to or part of the first side portion 328 and the second flex wing 306 is attached to or part of the second side portion 330. The first flex wing 304 includes first notches 334 defined along the length L1 of the first flex wing 304 and the second flex wing 306 includes second notches 336 defined along the length L2 of the second flex wing 306. The flexibility of the first and second flex wings 304 and 306 can be adjusted based on the number of first and second notches 334 and 336 per unit length. Also, the flexibility of the first and second flex wings 304 and 306 can be adjusted based on the thickness T (see FIG. 19) of the first and second flex wings 304 and 306. In some embodiments, the first and second flex wings 304 and 306 and the back support 308 are integrally formed, i.e., as a single, monolithic piece. In some embodiments the first and second flex wings 304 and 306 and the back support 308 are integrally formed in the same manufacturing process step. In some embodiments, the first and second flex wings 304 and 306 and the back support 308 are molded as a single, monolithic piece. In some embodiments, the first and second flex wings 304 and 306 are separate pieces attached to the back support 308, such as with one or more of adhesives, welding, fasteners, and mechanical engagement with the back support 308.

Figure 19:
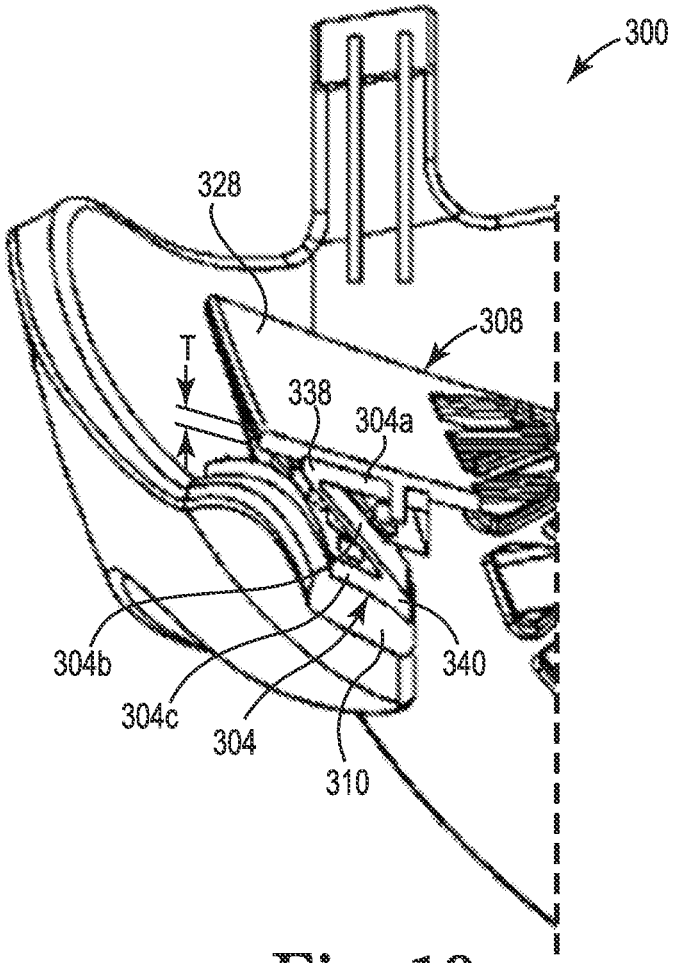
FIG. 19 is an enlarged diagram illustrating a cross-section of one side of the assembled back of FIG. 18, according to some embodiments.

FIG. 19 is an enlarged diagram illustrating a cross-section of one side of the assembled back 300, according to some embodiments. The cross-section of FIG. 19 is taken along a line that intersects the first and second flex wings 304 and 306. The cross-section enlarged diagram of FIG. 19 is similar to the enlarged diagram illustrating one side of the back 48 of FIG. 9. The one side of the back 300 that is shown in FIG. 19 is a mirror image of the other side of the back 300, but otherwise similar, such that both sides can be described with reference to the side of the back 300 shown in FIG. 19. Also, the first and second flex wings 304 and 306 are mirror images of each other, but otherwise similar, such that they can both be described with reference to one of the flex wings 304.

With reference to FIGS. 18 and 19, the first and second flex wings 304 and 306 are each Z-shaped resilient pieces that flex as user weight is applied to the back support 308. The first flex wing 304 includes a first front portion 304*a*, a first web portion 304*b*, and a first back portion 304*c*. The second flex wing 306 includes a second front portion 306*a*, a second web portion 306*b*, and a second back portion 306*c*. In some embodiments, the first front portion 304*a*, the first web portion 304*b*, and the first back portion 304*c* are integrally formed, i.e., as a single, monolithic piece. In some embodiments, the second front portion 306*a*, the second web portion 306*b*, and the second back portion 306*c* are integrally formed, i.e., as a single, monolithic piece. In some embodiments, the first front portion 304*a*, the first web portion 304*b*, and the first back portion 304*c* are integrally formed in the same manufacturing process step. In some embodiments, the second front portion 306*a*, the second web portion 306*b*, and the second back portion 306*c* are integrally formed in the same manufacturing process step. In some embodiments, the first front portion 304*a*, the first web portion 304*b*, and the first back portion 304*c* are formed of a resilient flexible material, such as a molded plastic. In some embodiments, the second front portion 306*a*, the second web portion 306*b*, and the second back portion 306*c* are formed of a resilient flexible material, such as a molded plastic. In some embodiments, two or more of the first front portion 304*a*, the first web portion 304*b*, and the first back portion 304*c* are separate pieces attached together, such as with one or more of adhesives, welding, fasteners, and mechanical engagement. In some embodiments, two or more of the second front portion 306*a*, the second web portion 306*b*, and the second back portion 306*c* are separate pieces attached together, such as with one or more of adhesives, welding, fasteners, and mechanical engagement.

The first and second flex wings 304 and 306 secure the back support 308 to the upright frame 302. The first front portion 304*a* of the first flex wing 304 is attached to or part of the first side portion 328 of the back support 308 and the second front portion 306*a* of the second flex wing 306 is attached to or part of the second side portion 330 of the back support 308. Also, the first back portion 304*c* is secured to the first back upright 310 to secure the first flex wing 304 to the first back upright 310 and the second back portion 306*c* is secured to the second back upright 312 to secure the second flex wing 306 to the second back upright 312.

With reference to FIG. 19, the first flex wing 304 includes a first flex region 338 defined by the first front portion 304*a* and the first web portion 304*b*, and a second flex region 340 defined by the first web portion 304*b* and the first back portion 304*c*. In some embodiments, the first web portion 304*b* extends away from the first front portion 304*a* at an acute angle. In some embodiments, the first web portion 304*b* extends away from the first front portion 304*a* at an angle in the range of 20-80 degrees. In some embodiments, the first web portion 304*b* extends away from the first back portion 304*c* at an acute angle. In some embodiments, the first web portion 304*b* extends away from the first back portion 304*c* at an obtuse angle.

The Z-shaped first and second flex wings 304 and 306 flex in response to the weight of a user similar to the way the Y-shaped first and second flex wings 60 and 62 flex in response to the weight of a user, as described in reference to FIGS. 10A-10D.

Figure 20:
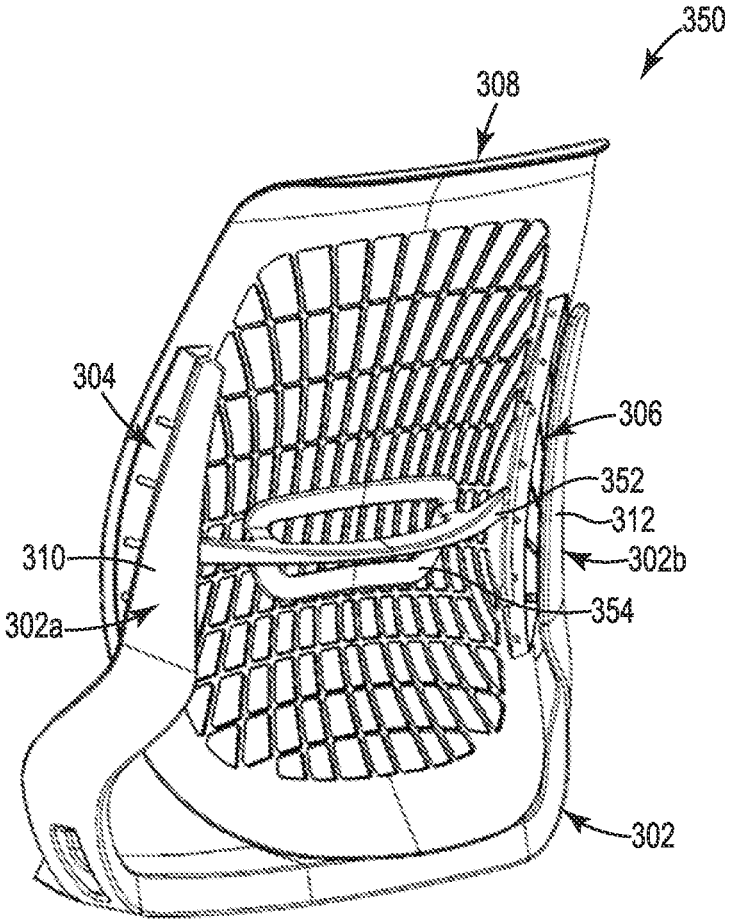
FIG. 20 is a diagram illustrating a perspective view of a back including a lumbar member, according to some embodiments.

FIG. 20 is a diagram illustrating a perspective view of a back 350 including a lumbar member 352, according to some embodiments. The back 350 is similar to the back 300, with the exception that the back 350 includes the lumbar member 352. The back 350 includes the same or similar components as the back 300 such that like numerals point to like components and the description above of the components of the back 300 applies to the components of the back 350.

For reference, the back 350 includes the U-shaped upright frame 302, the Z-shaped first and second flex wings 304 and 306 and the back support 308. The first and second flex wings 304 and 306 are secured to the upright frame 302 and to the back support 308, which secures the back support 308 to the upright frame 302.

The lumbar member 352 provides localized support to the back support 308, such as in the lower back region of the user. The lumbar member 352 is slidably engaged between the first frame side 302*a* and the second frame side 302*b* to slide vertically upward and downward and locally adjust support along the back 350. The lumbar member 352 includes a pad 354 to engage the back support 308 and provide forward pressure on the back support 308 to further support the back of the user.

In some embodiments, the lumbar member 352 is slidably engaged with the first back upright 310 and the second back upright 312 to slide vertically upward and downward and locally adjust support along the back 350. In some embodiments, the lumbar member 352 is slidably engaged with the first back upright 310 and the second back upright 312 similar to the way that the lumbar member 152 is slidably engaged with the first back upright 66 and the second back upright 68 as shown in FIGS. 13 and 14. In some embodiments, the lumbar member 352 is slidably engaged with the first back upright 310 and the second back upright 312 similar to the way that the lumbar member 242 is slidably engaged with the upright frame 244 shown in FIG. 17.

In some embodiments, the lumbar member 352 is slidably engaged with the first flex wing 304 and the second flex wing 306 to slide vertically upward and downward and locally adjust support along the back 350. In some embodiments, the lumbar member 352 is slidably engaged with the first flex wing 304 and the second flex wing 306 similar to the way that the lumbar member 202 is slidably engaged with the flex wing 204 shown in FIG. 16.

Figure 21:
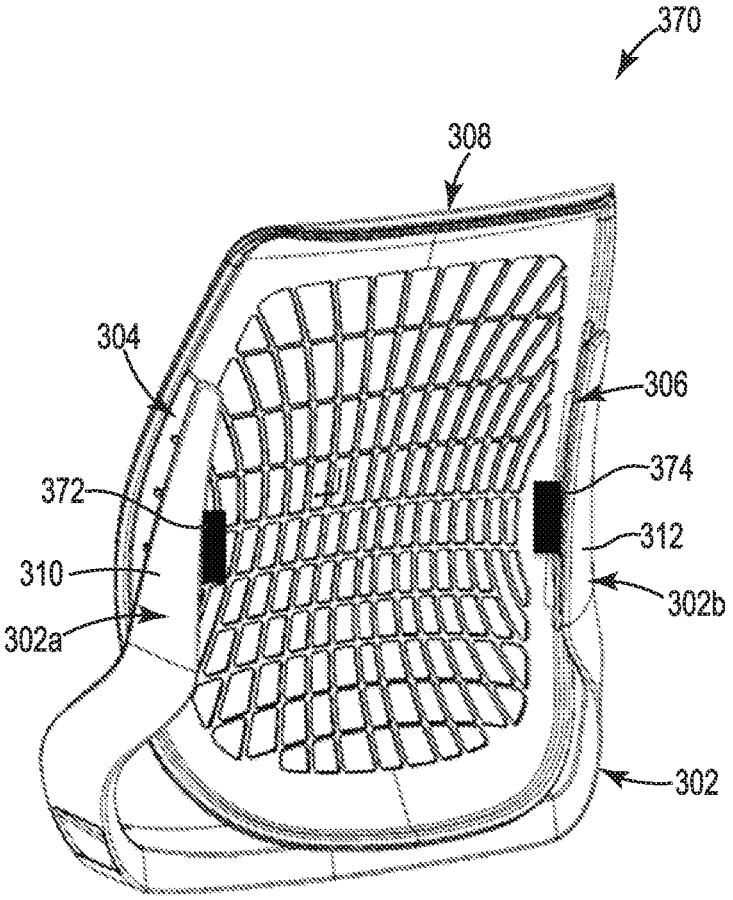
FIG. 21 is a diagram illustrating a perspective view of a back including a pair of lumbar members, according to some embodiments.

FIG. 21 is a diagram illustrating a perspective view of a back 370 including a pair of lumbar members 372 and 374, according to some embodiments. The back 370 is similar to the back 300, with the exception that the back 370 includes the lumbar members 372 and 374. The back 370 includes the same or similar components as the back 300 such that like numerals point to like components and the description above of the components of the back 300 applies to the components of the back 370.

For reference, the back 370 includes the U-shaped upright frame 302, the Z-shaped first and second flex wings 304 and 306 and the back support 308. The first and second flex wings 304 and 306 are secured to the upright frame 302 and to the back support 308, which secures the back support 308 to the upright frame 302.

The lumbar members 372 and 374 provide localized support to the back support 308, such as in the lower back region of the user. The lumbar member 372 is slidably engaged on the first frame side 302*a* to slide vertically upward and downward and locally adjust support along the back 370. The lumbar member 374 is slidably engaged on the second frame side 302*b* to slide vertically upward and downward and locally adjust support along the back 370.

In some embodiments, the lumbar member 372 is slidably engaged with the first back upright 310 and the lumbar member 374 is slidably engaged with the second back upright 312, to slide vertically upward and downward and locally adjust support along the back 370. In some embodiments, the lumbar member 372 is slidably engaged with the first back upright 310 and the lumbar member 374 is slidably engaged with the second back upright 312 similar to the way that the lumbar member 152 is slidably engaged with the first back upright 66 and the second back upright 68 shown in FIGS. 13 and 14. In some embodiments, the lumbar member 372 is slidably engaged with the first back upright 310 and the lumbar member 374 is slidably engaged with the second back upright 312 similar to the way that the lumbar member 242 is slidably engaged with the upright frame 244 as shown in FIG. 17.

In some embodiments, the lumbar member 372 is slidably engaged with the first flex wing 304 and the lumbar member 374 is slidably engaged with the second flex wing 306 to slide vertically upward and downward and locally adjust support along the back 370. In some embodiments, the lumbar member 372 is slidably engaged with the first flex wing 304 and the lumbar member 374 is slidably engaged with the second flex wing 306 similar to the way that the lumbar member 202 is slidably engaged with the flex wing 204 shown in FIG. 16.

Figure 22:
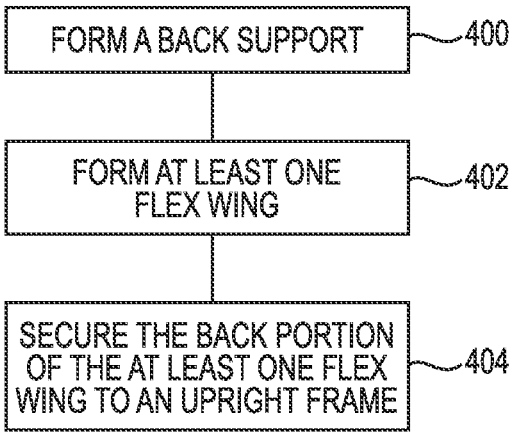
FIG. 22 is a flow chart diagram illustrating a method of making a chair back, according to some embodiments.

FIG. 22 is a flow chart diagram illustrating a method of making a chair back, such as any one of the backs 48, 170, 200, 240, 300, 350, and 370, according to some embodiments.

At 400, a back support that is substantially flexible and has a first side portion and a second side portion is formed. In some embodiments, the back support is integrally formed, i.e., as a single, monolithic piece. In some embodiments, the back support is formed of a flexible material, such as a thermoplastic. In some embodiments, the back support is formed of a flexible material, including a thermoplastic elastomer. In some embodiments, the back support is formed of a molded thermoplastic. In some embodiments, the back support is formed of a molded plastic that flexes under the weight of the user. In some embodiments, the back support includes separate pieces that are secured together, such as with one or more of adhesives, welding, fasteners, and mechanical engagement with each other.

At 402, at least one flex wing is formed, where the flex wing has a front portion that is positioned at the first side portion of the back support. The flex wing also includes a back portion and a web portion interconnecting the front portion and the back portion. Also, in some embodiments, another flex wing has a front portion that is positioned at the second side portion of the back support.

In some embodiments, the front portion, the web portion, and the back portion are integrally formed, i.e., as a single, monolithic piece. In some embodiments, the front portion, the web portion, and the back portion are integrally formed in the same manufacturing process step. In some embodiments, the front portion, the web portion, and the back portion are formed of a resilient flexible material, such as a molded plastic. In some embodiments, two or more of the front portion, the web portion, and the back portion are separate pieces attached together, such as with one or more of adhesives, welding, fasteners, and mechanical engagement with each other.

Also, in some embodiments, the flex wings and the back support are molded as a single, monolithic piece. In some embodiments the flex wings and the back support are integrally formed in the same manufacturing process step. In some embodiments, the flex wings and the back support are separate pieces attached to the back support, such as with one or more of adhesives, welding, fasteners, and mechanical engagement with the back support.

At 404, the back portion of the at least one flex wing is secured to a first frame side of an upright frame that is substantially rigid, such that the flex wing flexes in response to weight applied to the back support. Also, in some embodiments, another back portion of the other flex wing is secured to a second frame side of the upright frame, such that the flex wings flex in response to weight applied to the back support.

Various modifications and additions can be made to the exemplary embodiments discussed without departing from the scope of the present invention. For example, while the embodiments described above refer to particular features, the inventive scope also includes embodiments having different combinations of features and embodiments that do not include all of the above described features.

The following is claimed:

1. A chair back comprising:

a back support that is substantially flexible and has a first side portion and a second side portion;

an upright frame that is substantially rigid and has a first frame side and a second frame side;

a first flex wing located between the first frame side and the first side portion, the first flex wing including a front portion coupled to the first side portion, a back portion coupled to the first frame side, and a web portion interconnecting the front portion and the back portion such that the first flex wing flexes upon engagement by a user.

2. The chair back of claim 1, further comprising a second flex wing located between the second frame side and the second side portion.

3. The chair back of claim 1, wherein the first flex wing is integrally formed with the back support.

4. The chair back of claim 1, wherein the first flex wing is a separate component from, and mechanically coupled to, the first frame side.

5. The chair back of claim 1, wherein the first flex wing is configured such that the front portion folds toward the web portion and the web portion folds toward the back support as the back support bows during user engagement.

6. The chair back of claim 1, wherein the first flex wing includes a plurality of notches defined along a height of the first flex wing.

7. The chair back of claim 1, wherein the first flex wing defines a substantially Y-shaped transverse cross-section.

8. The chair back of claim 1, wherein the first flex wing defines a substantially Z-shaped transverse cross-section.

9. The chair back of claim 1, wherein the front portion, the back portion, and the web portion are separate pieces secured together to form the first flex wing.

10. The chair back of claim 1, wherein a transverse cross-section of the first flex wing includes the web portion extending from the front portion of the first flex wing at an acute angle.

11. The chair back of claim 1, wherein a transverse cross-section of the first flex wing includes the web portion extending from the front portion at an angle of about 20-80 degrees.

12. The chair back of claim 1, wherein a transverse cross-section of the first flex wing includes the web portion extending from the back portion of the first flex wing at an acute angle.

13. The chair back of claim 1, wherein a transverse cross-section of the first flex wing includes the web portion extending from the back portion of the first flex wing at an obtuse angle.

14. The chair back of claim 1, wherein the first frame side defines a receiving channel and the back portion of the first flex wing is positioned in the receiving channel of the first frame side to secure the first flex wing to the first frame side.

15. The chair back of claim 1, wherein the front portion and the web portion of the first flex wing define a first flex region of the first flex wing and the back portion and the web portion of the first flex wing define a second flex region of the first flex wing.

16. The chair back of claim 1, wherein the front portion and the web portion of the first flex wing define a first flex region and the back portion and the web portion of the first flex wing define a second flex region, and further wherein the first flex wing is configured such that the front portion of the first flex wing flexes inwardly toward the web portion about the first flex region as the back support bows during user engagement.

17. The chair back of claim 1, wherein the front portion and the web portion of the first flex wing define a first flex region and the back portion and the web portion of the first flex wing define a second flex region, and further wherein the first flex wing is configured such that the web portion of the first flex wing flexes inwardly toward a center of the back support about the second flex region as the back support bows during user engagement.

18. The chair back of claim 1, comprising a first lumbar member having a first end, wherein at least one of the first frame side and the first flex wing includes a first lumbar track for receiving the first end of the first lumbar member such that the first lumbar member provides local resistance to compression of the first flex wing.

19. The chair back of claim 18, comprising a second lumbar member having a second end, wherein at least one of the second frame side and the second flex wing includes a second lumbar track for receiving the second end of the second lumbar member such that the second lumbar member provides local resistance to compression of the second flex wing.

20. The chair back of claim 1, comprising a lumbar member having a first end and a second end, wherein the first flex wing includes a first lumbar track for receiving the first end of the lumbar member and the second flex wing includes a second lumbar track for receiving the second end of the lumbar member such that the lumbar member extends between the first flex wing and the second flex wing to provide local resistance to compression of the first flex wing and the second flex wing.

21. The chair back of claim 20, wherein the lumbar member includes a pad configured to engage the back support to provide forward pressure on the back support.

22. The chair back of claim 1, comprising a lumbar member having a first end and a second end, wherein the first frame side includes a first lumbar track for receiving the first end of the lumbar member and the second frame side includes a second lumbar track for receiving the second end of the lumbar member such that the lumbar member extends between the first frame side and the second frame side to provide local resistance to compression of the first flex wing and the second flex wing.

23. The chair back of claim 22, wherein the lumbar member includes a pad configured to engage the back support to provide forward pressure on the back support.

24. The chair back of claim 1, wherein the upright frame comprises:

a first back upright that is substantially rigid; and a second back upright that is substantially rigid and positioned opposite the first back upright, wherein the first flex wing is located between the first back upright and the first side portion and the front portion is coupled to the first side portion and the back portion is coupled to the first back upright.

25. The chair back of claim 24, wherein the first back upright is attached to the second back upright by a transverse member such that the first back upright, the second back upright, and the transverse member form a U-shaped support.

26. A chair comprising:

a base to support the chair on a surface;

a seat supported by the base; and a back supported by the base, wherein the back includes:

a first upright and a second upright;

a first wing attached to the first upright and including a first web portion;

a second wing attached to the second upright and including a second web portion; and a back support attached to the first upright and the second upright via the first wing and the second wing such that the first web portion extends between the back support and the first upright and the second web portion extends between the back support and the second upright.

27. The chair of claim 26, wherein the back support includes a perimeter ring and a central region that defines a plurality of apertures arranged in a grid pattern.

28. The chair of claim 26, wherein the back support is formed of a molded plastic that flexes during user engagement.

29. The chair of claim 26, wherein the back support is formed of a molded thermoplastic.

30. The chair of claim 26, wherein the back support includes a molded plastic ring carrier and a mesh secured to the molded plastic ring carrier.

31. The chair of claim 26, wherein the back support is covered with a knit upholstery.

32. A method of making a chair back comprising:

forming a back support that is substantially flexible and has a first side portion and a second side portion;

forming a first flex wing that has a front portion positioned at the first side portion of the back support, a back portion, and a web portion interconnecting the front portion and the back portion; and securing the back portion to a first frame side of an upright frame that is substantially rigid, such that the first flex wing flexes in response to user force applied to the back support.

33. The method of claim 32, comprising securing a second flex wing positioned at the second side portion of the back support to a second frame side of the upright frame, such that the first flex wing and the second flex wing flex in response to user force applied to the back support.

34. The method of claim 32, comprising integrally forming the front portion of the first flex wing with the first side portion of the back support.

35. The method of claim 32, wherein the first flex wing and the first side portion are non-integral components, the method further comprising securing the front portion of the first flex wing to the first side portion of the back support.

* * * * *